US006003636A

United States Patent [19]

Yumura

[11] Patent Number: 6,003,636

[45] Date of Patent: Dec. 21, 1999

[54] SAFETY APPARATUS FOR ELEVATOR

[75] Inventor: Takashi Yumura, Tokyo, Japan

[73] Assignee: Mitsubishi Denki Kabushiki Kaisha, Tokyo, Japan

[21] Appl. No.: 08/867,805

[22] Filed: Jun. 3, 1997

[30] Foreign Application Priority Data

Jun. 11, 1996 [JP] Japan ..... 8-149622

[51] Int. Cl.[6] ..... B66B 5/04

[52] U.S. Cl. ..... 187/376; 188/189

[58] Field of Search ..... 187/376, 372, 187/373, 350; 188/188, 189

[56] References Cited

U.S. PATENT DOCUMENTS

| | | | |
|---|---|---|---|
| 2,326,046 | 8/1943 | McCormick | 187/88 |
| 5,065,845 | 11/1991 | Pearson | 187/376 |
| 5,301,773 | 4/1994 | Jamieson et al. | 187/88 |
| 5,366,044 | 11/1994 | Jamieson et al. | 187/359 |
| 5,366,045 | 11/1994 | Liston | 187/376 |
| 5,467,850 | 11/1995 | Skalski | 188/165 |
| 5,628,385 | 5/1997 | Yumura et al. | 187/373 |

FOREIGN PATENT DOCUMENTS

| | | |
|---|---|---|
| 5-147852 | 6/1993 | Japan . |
| 7-307730A | 11/1995 | Japan . |

OTHER PUBLICATIONS

T. Hata et al., "How to Use PLL–IC", Akiba, pp. 20–32, Nov. 1976.

*Primary Examiner*—Kenneth W. Noland
*Attorney, Agent, or Firm*—Sughrue, Mion, Zinn, Macpeak & Seas, PLLC

[57] ABSTRACT

A safety apparatus for an elevator of the present invention includes an emergency stopping mechanism for generating a high frictional force to brake the elevator, a driving apparatus for operating the emergency stopping mechanism, a cam latch mechanism for releasing the driving apparatus when the speed of movement of the elevator reaches a critical speed, and a governor for activating the cam latch mechanism

16 Claims, 26 Drawing Sheets

21
34
35
55
57

FIG.20(a)
FIG.20(c)
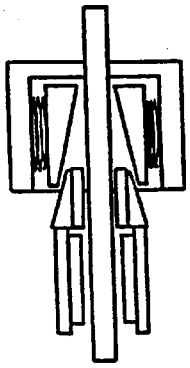
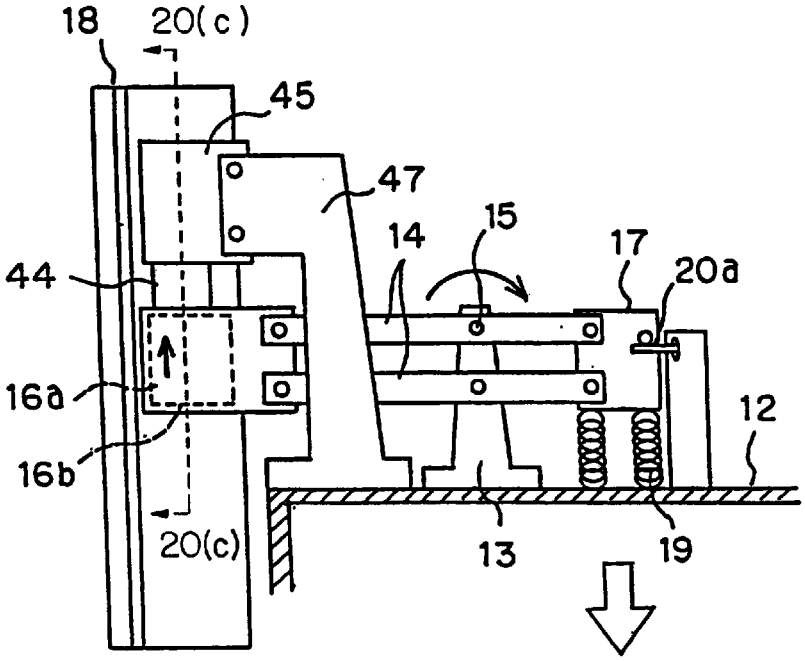
FIG.20(d)
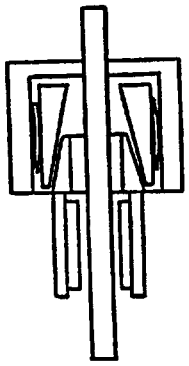
FIG.20(b)
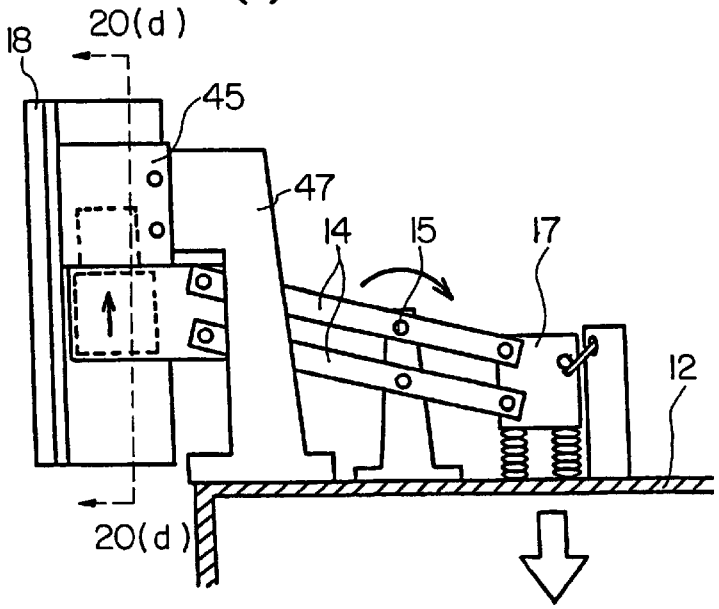

SAFETY APPARATUS FOR ELEVATOR

BACKGROUND OF THE INVENTION

1. Field of the Invention

This invention relates to a safety apparatus for an elevator which brakes the elevator when the speed of movement of the elevator reaches a prescribed critical speed.

2. Description of the Prior Art

FIGS. 24(*a*) and 24(*b*) are a front elevational view and a plan view, respectively, of a governor which is a conventional safety apparatus for an elevator. Referring to FIGS. 24(*a*) and 24(*b*), reference numeral 12 denotes a cage of the elevator, 13 a base of the elevator governor provided on the cage 12, and 14 an arm composed of two pairs of parallel links supported pivotally around fulcra 15 on the base 13. Reference numeral 16 denotes a pickup connected at two points to an end of the arm 14 for detecting a rapid speed of the elevator. The pickup 16 has a magnetic circuit composed of a pair of magnets 16*a* disposed in an opposing relationship to a fixed conductor 18 on the opposite sides of the fixed conductor 18, and a back yoke 16*b* for assuring a path for magnetic fluxes of the magnets 16*a*. Reference numeral 17 denotes a balance weight provided at the other end of the arm 14 in a balanced relationship with the pickup 16. It is to be noted that the governor is composed of the arm 14, fulcra 15 of the base, pickup 16 and balance weight 17. Reference numeral 19 denotes a spring which holds the arm 14 and converts a force (drag) acting upon the balance weight 17 into a displacement. Reference numeral 20*a* denotes a cage stopping switch, and this cage stopping switch 20*a* disconnects, by a displacement of the balance weight 17, a power supply for a winding machine or the like (not shown) for moving the elevator up and down. Reference numeral 21 denotes an emergency stopping operation bar, and this emergency stopping operation bar 21 activates an emergency stopping apparatus (brake apparatus (not shown)).

Operation of the governor which is a conventional safety apparatus for an elevator is described below.

The pickup 16 has a magnetic circuit composed of the magnets 16*a* and the back yoke 16*b* and produces a magnetic field perpendicular to the plane of the fixed conductor 18 located between the two magnets 16*a*. When the cage 12 moves up or down and the magnetic field moves in the fixed conductor 18, such eddy current as cancels a variation of the magnetic field is generated in the fixed conductor 18, and a force (magnetic drag) having a magnitude corresponding to the speed of the cage 12 and acting in a direction to resist the movement of the cage 12 is generated on the magnets 16*a*. It is to be noted that a relationship between the speed V of the cage 12 and the generated magnetic drag F1 is illustrated in FIG. 26. This magnetic drag F1 is converted into a displacement of the pickup 16 and the balance weight 17 in the upward or downward direction by the arm 14 and the springs 19 as seen in FIG. 25. It is to be noted that a relationship between the pickup displacement (balance weight displacement) Z and the spring force F2 is illustrated in FIG. 27, and a relationship between the speed V of the cage 12 and the pickup displacement (balance weight displacement) Z is illustrated in FIG. 28.

When the speed of downward movement of the cage 12 reaches a first over-speed (normally set to approximately to 1.3 times a rated speed) higher than a predetermined value, the magnets 16*a* are acted upon by an upward magnetic drag corresponding to the speed and displaces the balance weight 17 downwardly. Then, as a result of the displacement, the cage stopping switch 20*a* operates to disconnect the power supply to the elevator driving apparatus and the cage 12 stops. On the other hand, also when the speed of downward movement of the cage 12 reaches a second over-speed (normally set to approximately 1.4 times the rated speed) by some cause, the balance weight 17 is further displaced downwardly corresponding to the speed, and as a result of the displacement, the emergency stopping operation bar 21 moves to operate the emergency stopping apparatus (not shown) provided for the cage 12 so that the cage 12 is stopped suddenly.

It is to be noted that, in addition to the prior art described above, a technique similar to the present invention is disclosed in JP-A 5-147852 or JP-A 6-321454.

Since the conventional safety apparatus for an elevator is constructed in such a manner as described above, it has the following subjects.

(a) In the conventional safety apparatus for an elevator, since the magnetic drag generated by eddy current is low comparing with a force necessary to activate the emergency stop and, even when the speed of downward movement of the cage reaches the second over-speed, the displacement of the pickup is small, there is a subject in that it is difficult only for the magnetic drag to activate the emergency stop and the stability of operation is low.

(b) In the conventional safety apparatus for an elevator, while a balance weight is provided such that it may be balanced with the pickup, since the balance weight is connected to the emergency stopping apparatus (brake apparatus) by the emergency stopping operation bar or a like member, the entire connected apparatus is not in a well-balanced state, and consequently, there is another subject in that the pickup is liable to be displaced by a force applied to the case such as vibrations of the case (when passengers get in or out), and consequently, a malfunction is likely to occur.

(c) In the conventional safety apparatus for an elevator, since the pickup is mounted at an end of the arm and the balance weight is mounted at the other end of the arm to establish a well-balanced relationship, there is a further subject in that a downward force for canceling the emergency stop cannot be applied in an ordinary operation and, even if it is tried to cancel a situation that the emergency stopping apparatus bites in the guide rail after the emergency stopping apparatus operates, the emergency stopping apparatus does not restore its initial state readily.

(d) In the conventional safety apparatus for an elevator, if the speed of the cage temporarily fluctuates oscillatorily to a large extent when passengers get in or out or when passengers in the cage move violently, then the displacement of the pickup exhibits a large amount, and there is a still further subject in that the safety apparatus is liable to malfunction.

(e) In the conventional safety apparatus for an elevator, since the governor and the emergency stopping apparatus are disposed separately above and below the cage, there is a yet further subject in that the safety apparatus has a large size as a whole.

(f) In the conventional safety apparatus for an elevator, upon operation inspection or checking when it is installed at the site or maintenance of it is performed, the cage must actually be moved to check the operation, and there is a yet further subject in that an inspection or checking is difficult and dangerous.

SUMMARY OF THE INVENTION

The present invention has been made to solve such subjects as described above, and it is an object of the present invention to provide a safety apparatus for an elevator wherein an emergency stopping apparatus can be operated with certainty even if the magnetic drag of a governor which is generated when the speed of the elevator reaches a second over-speed is not sufficiently high.

It is another object of the present invention to provide a safety apparatus for an elevator which malfunctions less likely even if oscillations are produced with a cage.

It is a further object of the present invention to provide a safety apparatus for an elevator wherein, after an emergency stop operates, the emergency stop can be canceled readily and an initial state can be restored readily.

It is a still further object of the present invention to provide a safety apparatus for an elevator which malfunctions less likely even if the speed of a cage temporarily fluctuates oscillatorily by a large amount when passengers get in or out or when passengers move violently in the cage.

It is a yet further object of the present invention to provide a safety apparatus for an elevator which is small in size and simple in structure.

It is a yet further object of the present invention to provide a safety apparatus for an elevator for which an inspection or maintenance can be performed readily.

According to a first aspect of the present invention, there is provided a safety apparatus for an elevator, comprising a guide rail of a conductor securely disposed along a path of upward and downward movement of the elevator, an emergency stopping mechanism mounted on a movable section of the elevator for gripping the guide rail to generate a frictional force to brake the movable section, a governor mounted on the movable section for being displaced when a speed of the movable section reaches a critical speed to activate the emergency stopping mechanism, and an emergency stopping operation mechanism for transmitting the displacement of the governor to said emergency stopping mechanism.

According to a second aspect of the present invention, there is provided a safety apparatus for an elevator, comprising a guide rail of a conductor securely disposed along a path of upward and downward movement of the elevator, an emergency stopping mechanism mounted on a movable section of the elevator for gripping the guide rail to generate a frictional force to brake the movable section, a driving apparatus for operating the emergency stopping mechanism, a cam latch mechanism mounted on the movable section for releasing, when a speed of the movable section reaches a critical speed, a driving force of the driving apparatus which has been restricted till then, and a governor mounted on the movable section for being displaced when the speed of the movable section reaches the critical speed to activate the cam latch mechanism.

According to a third aspect of the present invention, the safety apparatus for an elevator is constructed such that the governor includes a pickup including a magnet and a back yoke which form a magnetic circuit together with the guide rail, a pivotal arm having the pickup mounted at an end thereof and having a balance weight mounted at the other end thereof for transmitting a displacement of the pickup, a main shaft securely mounted at a fulcrum of the arm so as to be rotated in response to a displacement of the arm, and a base for supporting the main shaft thereon.

According to a fourth aspect of the present invention, the safety apparatus for an elevator is constructed such that the governor includes a cam mounted on a main shaft of the governor which is rotated in accordance with a speed of the movable section, and a latch arm mounted on the governor by a latch pin for pivotal motion around an axis of the latch pin and having an end held in contact with the cam and the other end connected to the driving apparatus, and when the speed of the movable section reaches the critical speed, the cam is rotated to release the driving force of the driving apparatus.

According to a fifth aspect of the present invention, the safety apparatus for an elevator is constructed such that the driving apparatus includes a pulling up bar connected at an end thereof to the cam latch mechanism and at the other end thereof to the emergency stopping mechanism, and a spring element for lifting the pulling up bar when the speed of the movable section reaches the critical speed.

According to a sixth aspect of the present invention, there is provided a safety apparatus for an elevator, comprising a guide rail of a conductor securely disposed along a path of upward and downward movement of the elevator, an emergency stopping mechanism mounted on a movable section of the elevator for gripping the guide rail to generate a frictional force to brake the movable section, a pulling up wedge mechanism disposed for wedging engagement with the guide rail to generate a driving force for the emergency stopping mechanism, a cam latch mechanism mounted on the movable section for cooperating, when a speed of the movable section reaches a critical speed, with the pulling up wedge mechanism to activate the pulling up wedge mechanism, a governor mounted on the movable section for being displaced when the speed of the movable section reaches the critical speed to activate the cam latch mechanism, and a link apparatus for connecting the cam latch mechanism to the emergency stopping mechanism to transmit the driving force generated by the pulling up wedge mechanism to the emergency stopping mechanism According to a seventh aspect of the present invention, there is provided a safety apparatus for an elevator, comprising a guide rail of a conductor securely disposed along a path of upward and downward movement of the elevator, an emergency stopping mechanism mounted on a movable section of the elevator for gripping the guide rail to generate a frictional force to brake the movable section, a governor for being displaced when a speed of the movable section reaches a critical speed, a pulling up wedge mechanism mounted on the governor for wedging engagement with the guide rail to generate a driving force for the emergency stopping mechanism, and a link apparatus for connecting the governor to the emergency stopping mechanism to transmit a driving force generated by the pulling up wedge mechanism to the emergency stopping mechanism.

According to an eighth aspect of the present invention, the safety apparatus for an elevator is constructed such that it further comprises an auxiliary weight provided on any of the governor, emergency stopping operation mechanism and emergency stopping mechanism which is moved by the displacement of the governor.

According to a ninth aspect of the present invention, the safety apparatus for an elevator is constructed such that the auxiliary weight is provided on an emergency stopping arm.

According to a tenth aspect of the present invention, the safety apparatus for an elevator is constructed such that it further comprises a cancellation arm provided on any of the governor, emergency stopping operation mechanism and emergency stopping mechanism which is moved by the displacement of the governor According to an eleventh aspect of the present invention, the safety apparatus for an elevator is constructed such that it further comprises a cancellation cam provided along the path of upward and downward movement of the elevator for engaging with the cancellation arm.

According to a twelfth aspect of the present invention, the safety apparatus for an elevator is constructed such that it further comprises an emergency stop cancellation mechanism including a holding down bar connected at an end thereof to the cam latch mechanism and at the other end thereof to the emergency stopping mechanism and a hook apparatus for being engaged with and restricting the driving apparatus when the holding down bar moves upwardly but releasing the engagement and restriction of the driving apparatus when the holding down bar moves downwardly.

According to a thirteenth aspect of the present invention, the safety apparatus for an elevator is constructed such that the hook apparatus includes a hook mounted on the holding down bar, and an unhooking pin mounted on the governor for releasing a pulling up bar when the holding down bar moves downwardly.

According to a fourteenth aspect of the present invention, the safety apparatus for an elevator is constructed such that the emergency stopping mechanism includes an emergency stopping arm mounted for pivotal motion on the movable section, an emergency stopping shoe mounted at an end portion of the emergency stopping arm, and an emergency stopping biting metal member disposed for wedging engagement with the emergency stopping shoe and the guide rail, that the driving apparatus includes a pulling up bar having an end connected to the cam latch mechanism and the other end connected for sliding movement to a portion of the emergency stopping arm in the proximity of a pivot shaft of the emergency stopping arm via an elongated hole, and a spring element for lifting the pulling up bar when the speed of the movable section reaches the critical speed, that the emergency stop cancellation mechanism includes a holding down bar having an end connected for sliding movement to the cam latch mechanism via an elongated hole and the other end connected to an end portion of the emergency stopping arm, and a hook apparatus mounted on the holding down bar for being engaged with and restricting the pulling up bar when the holding down bar moves upwardly but releasing the engagement and restriction of the pulling up bar when the holding down bar moves downwardly, and that the holding down bar is moved, upon emergency stopping operation, upwardly over an extent larger by an amount corresponding to a length of the elongated hole than the pulling up bar due to a difference between displacements of locations of the emergency stopping arm different from the center of pivotal motion so that the hook apparatus is engaged with and restricts the pulling up bar, but upon emergency stopping cancellation operation, when the movable section is moved upwardly, while the emergency stopping biting metal member remains in wedging engagement with the guide rail, the emergency stopping arm is moved downwardly so that the holding down bar connected to the emergency stopping arm is moved downwardly and the pulling up bar which has been engaged with and restricted by the hook apparatus is moved downwardly by a displacement amount equal to that of the holding down bar until the engagement and restriction is cancelled at a position at which the driving apparatus restores an initial state.

According to a fifteenth aspect of the present invention, the safety apparatus for an elevator is constructed such that it further comprises an oscillation absorption apparatus provided on any of the governor, emergency stopping operation mechanism and emergency stopping mechanism for absorbing oscillations.

According to a sixteenth aspect of the present invention, there is provided a safety apparatus for an elevator, comprising a guide rail of a conductor securely disposed along a path of upward and downward movement of the elevator, a governor for being displaced when a speed of a movable section reached a critical speed, and an emergency stopping mechanism provided on the governor for operating directly in response to a displacement of the governor to grasp the guide rail to generate a frictional force to brake the movable section.

BRIEF DESCRIPTION OF THE DRAWINGS

FIGS. 20(*a*) and 20(*d*) are views illustrating an emergency stopping operation of a safety apparatus for an elevator according to Embodiment 5 of the present invention;

DETAILED DESCRIPTION OF THE PREFERRED EMBODIMENTS

In the following, preferred embodiments of the present invention are described.

Embodiment 1

In the conventional safety apparatus for an elevator, the magnetic drag by eddy current is so low that it is difficult only for the magnetic drag by eddy current to lift the pulling up bar to activate the emergency stopping apparatus. Further, also a cancellation method after the emergency stopping apparatus operates is not available. In Embodiment 1, triggering of an emergency stopping operation at a second over-speed is performed by a governor and a cam latch mechanism and a driving force for performing the emergency stopping operation is generated by a spring apparatus such as a spring while an emergency stop cancellation operation is realized by a hook apparatus.

Figure 1:
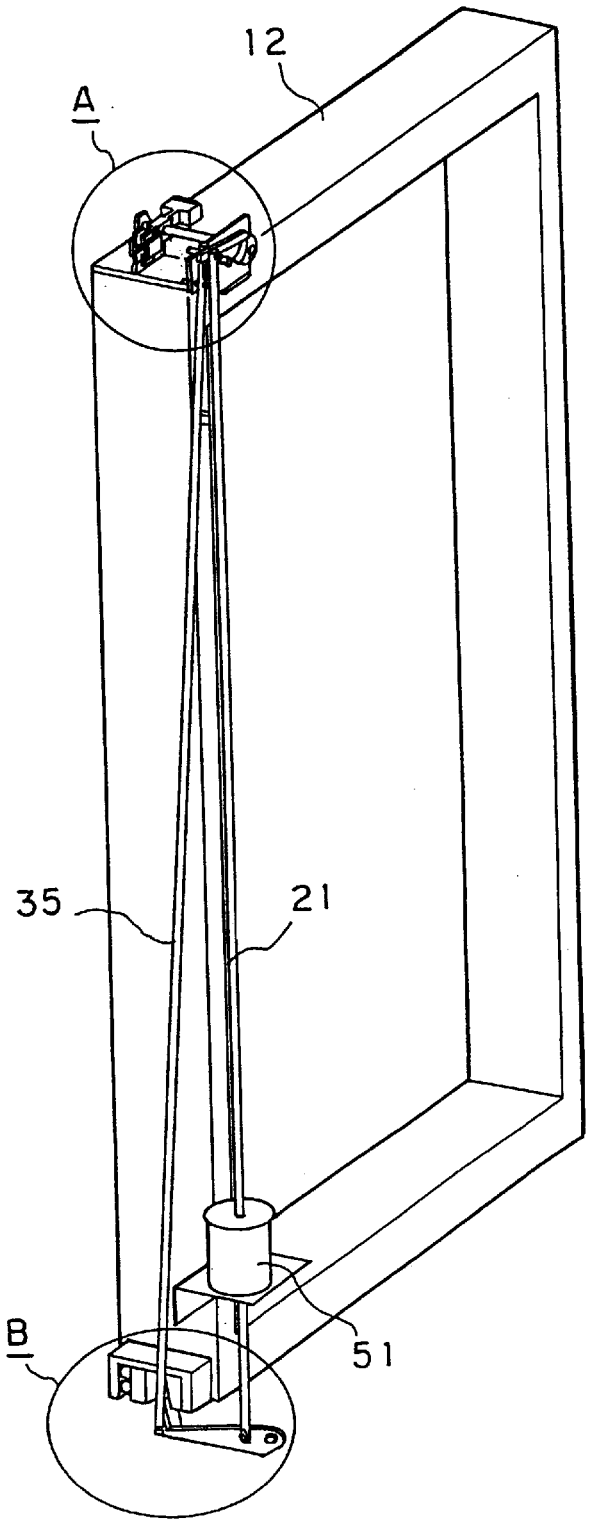
FIG. 1 is a perspective view showing a general construction of a safety apparatus for an elevator according to Embodiment 1 of the present invention.

FIG. 1 is a perspective view showing a general construction of a safety apparatus for an elevator according to Embodiment 1 of the present invention. Referring to FIG. 1, reference numeral 12 denotes a cage frame (movable section) mounted on a cage of an elevator, 21 a pulling up bar (driving apparatus, link apparatus, emergency stopping operation mechanism), 35 a holding down bar (emergency stop cancellation mechanism), and 51 a pulling up spring (spring apparatus, driving apparatus, emergency stopping operation mechanism). A portion surrounded by a circle A is a portion which constructs a governor of the safety apparatus for an elevator, and another portion surrounded by another circle B is a portion which constructs an emergency stopping apparatus of the safety apparatus for an elevator.

Figure 24A:
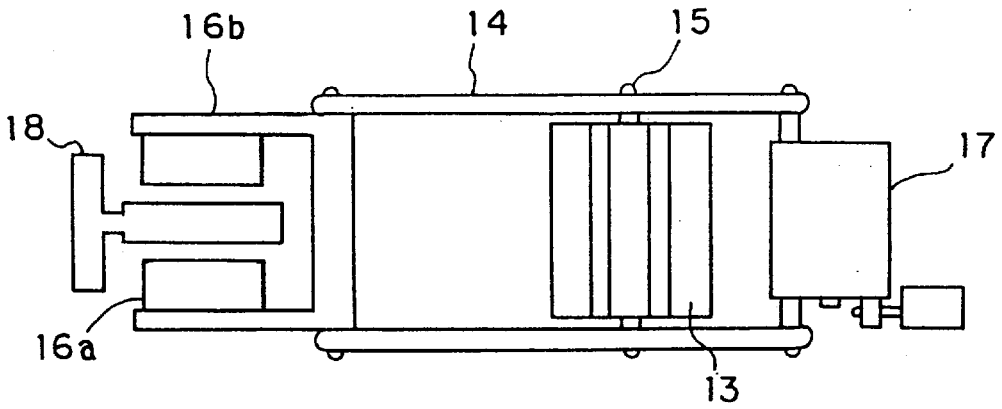
FIG.24(a)(PRIOR ART)
FIGS. 24(*a*) and 24(*b*) are a front elevational view and a plan view, respectively, of a governor which is a conventional safety apparatus for an elevator.
Figure 24B:
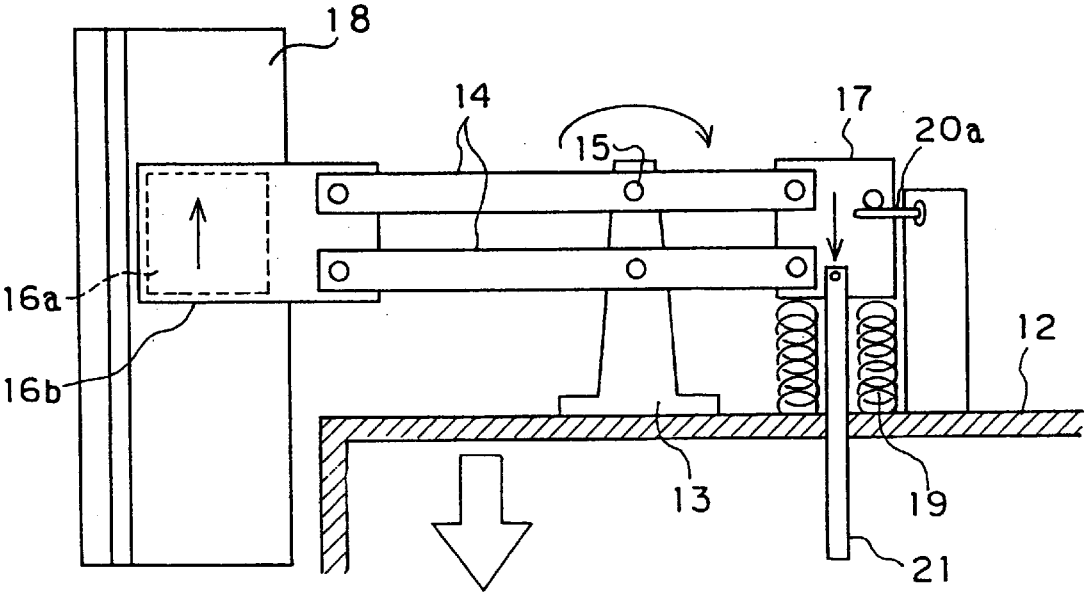
FIG.24(b)(PRIOR ART)
Figure 25:
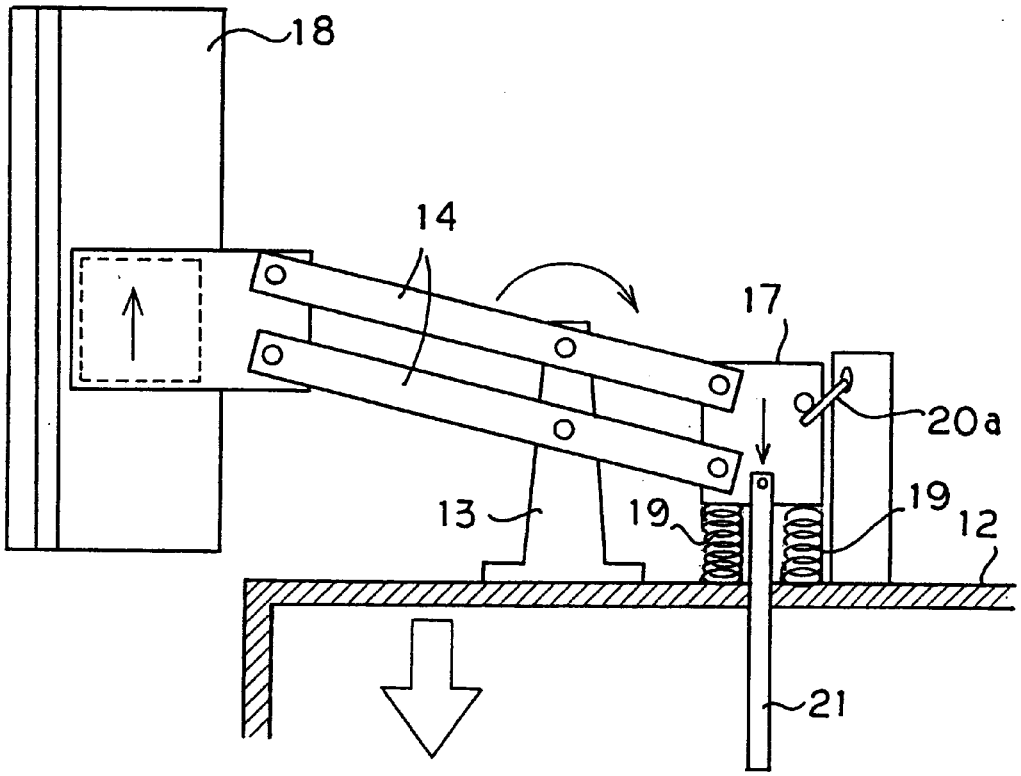
FIG.25(PRIOR ART)
FIG. 25 is a front elevational view of the governor, which is a conventional safety apparatus for an elevator, after an operation.
Figure 26:
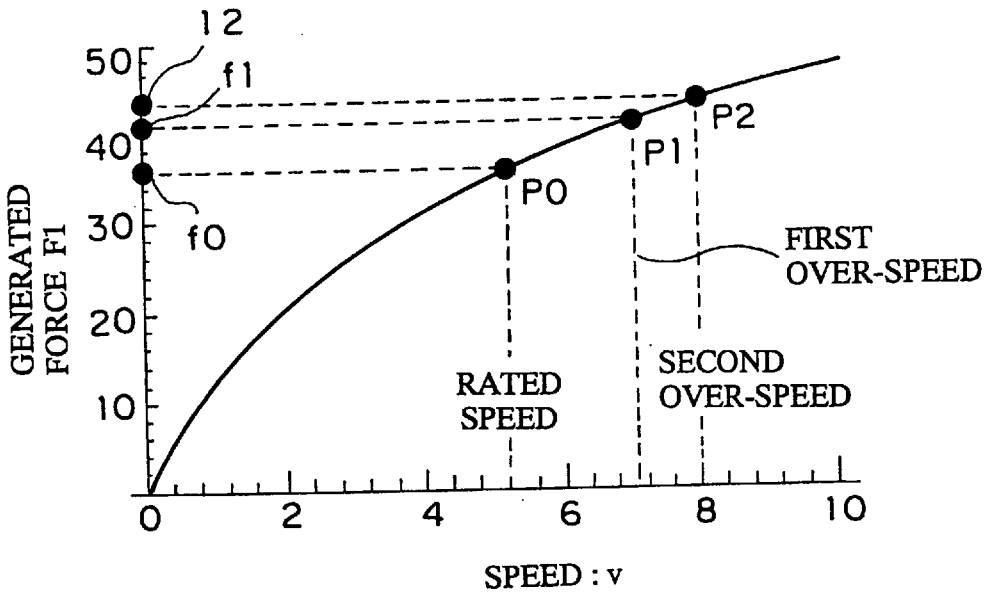
FIG.26(PRIOR ART)
FIG. 26 is a diagram illustrating a relationship between the speed V of a cage and the generated magnetic drag F1.
Figure 27:
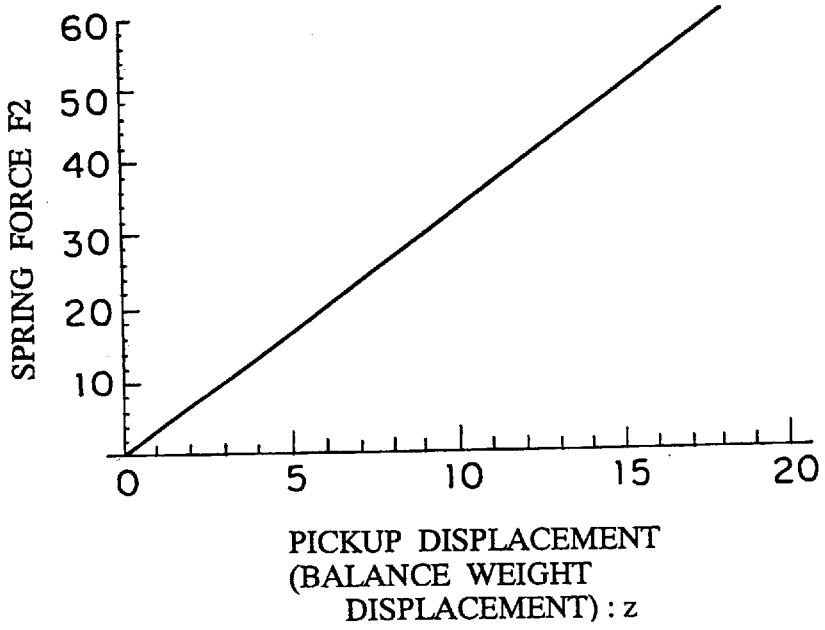
FIG.27(PRIOR ART)
FIG. 27 is a diagram illustrating a relationship between the pickup displacement (balance weight displacement) Z and the spring force F2.
Figure 28:
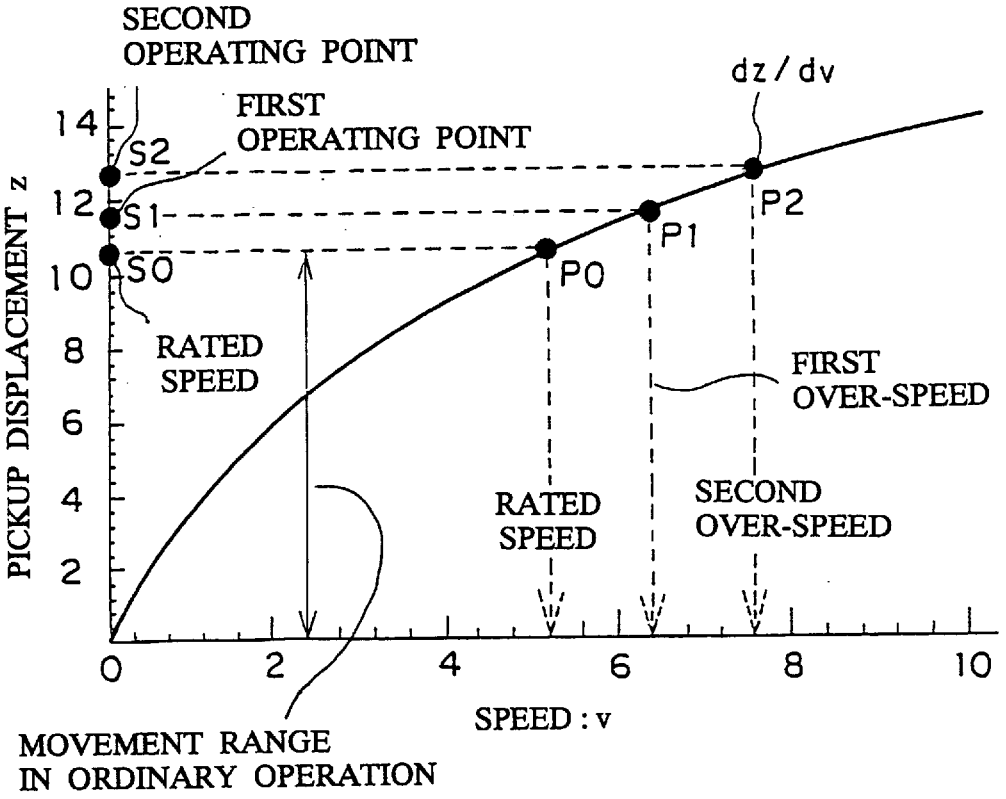
FIG.28(PRIOR ART)
FIG. 28 is a diagram illustrating a relationship between the speed V of a cage frame and the pickup displacement (balance weight displacement) Z.

It is to be noted that, in FIG. 1, the guide rail (fixed conductor) 18 shown in FIGS. 24(*a*) and 24(*b*) are omitted.

Figure 2:
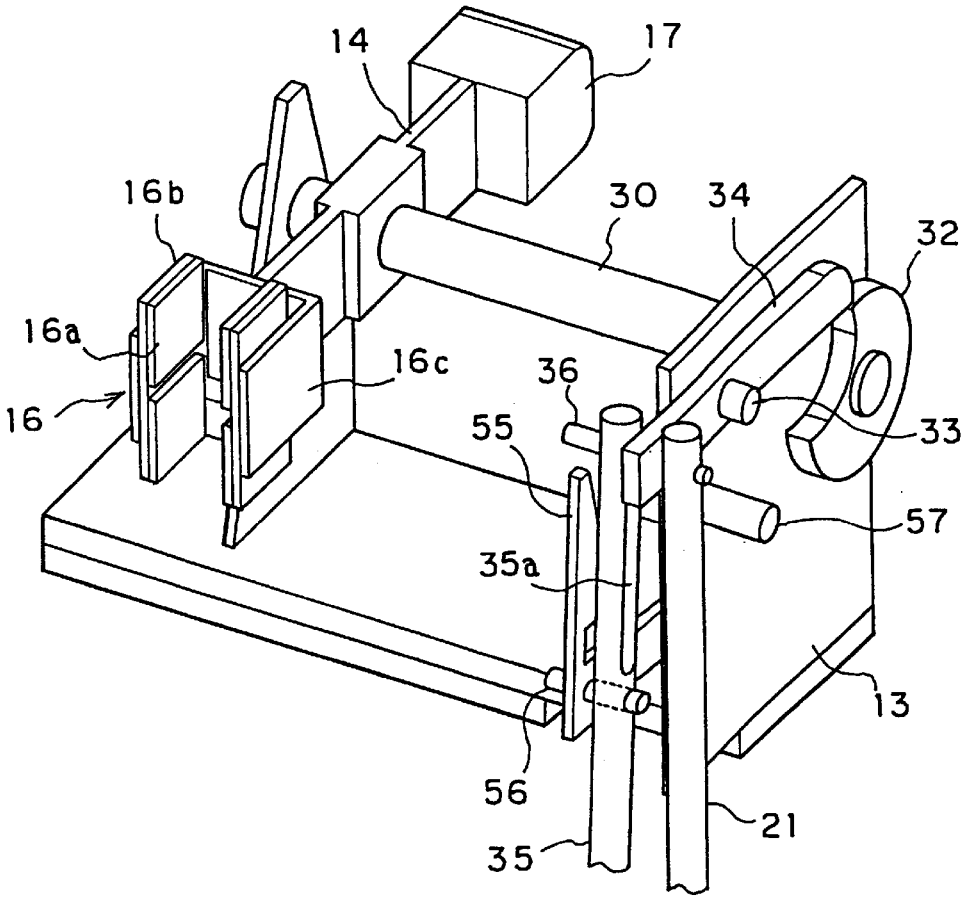
FIG. 2 is a perspective view showing a construction of a governor (and part of an emergency stop cancellation mechanism) (an enlarged view of a portion of FIG. 1 surrounded by a circle A)

FIG. 2 is a perspective view showing a construction of the governor and a cam latch mechanism (an enlarged view of a portion of FIG. 1 surrounded by the circle A). Referring to FIG. 2, reference numeral 13 denotes a base (governor) of the governor provided on the cage frame 12, and this base 13 is formed in a channel-shape. Reference numeral 30 denotes a main shaft (governor) supported at the opposite ends thereof for rotation on the channel-shaped base 13, and 14 a governor arm (arm, governor) securely connected to the main shaft 30 and pivotally supported around an axis of the main shaft 30 such that, when the governor arm 14 is pivoted, the main shaft 30 is rotated. Reference numeral 16 denotes a pickup (governor) connected at two points to one end of the governor arm 14, and the pickup 16 includes a pair of magnets 16*a* (pickup, governor) disposed on the opposite sides of the guide rail 18 (omitted in FIG. 2) in an opposing relationship to the guide rail 18, and a pair of back yokes 16*b* and 16*c* for assuring a passage for magnetic fluxes of the magnets 16*a*. The back yoke 16*c* is connected to the governor arm 14. Reference numeral 17 denotes a balance weight (governor) provided at the other end of the governor arm 14 in a balanced relationship with the pickup 16.

Reference numeral 32 denotes a cam (cam latch mechanism, emergency stopping operation mechanism) mounted at one end of the main shaft 30. The cam 32 is rotated when the main shaft 30 rotates. Reference numeral 33 denotes a latch shaft mounted on the channel-shaped base 13 (on the side on which the cam 32 is mounted), and 34 a latch arm (cam latch mechanism, emergency stopping operation mechanism) connected for pivotal motion to the latch shaft 33 around an axis of the latch shaft 33. The latch arm 34 is held in contact at an end thereof with the cam 32, and the pulling up bar 21 and the holding down bar 35 are connected for pivotal motion to the other end portion of the latch arm 34 by a latch pin 36 (cam latch mechanism, emergency stopping operation mechanism). An elongated hole 35*a* (holding down bar) is provided in the holding down bar 35, and the latch pin 36 is received for movement in the upward and downward directions in the elongated hole 35*a*.

Figure 3:
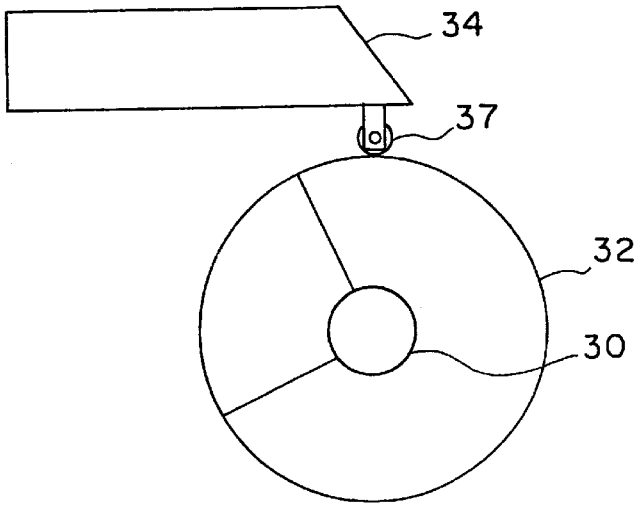
FIG. 3 is a view showing a friction reduction mechanism such as a bearing roller or a ball mechanism for reducing the friction at a contact between a latch arm and a cam.
Figure 4A:
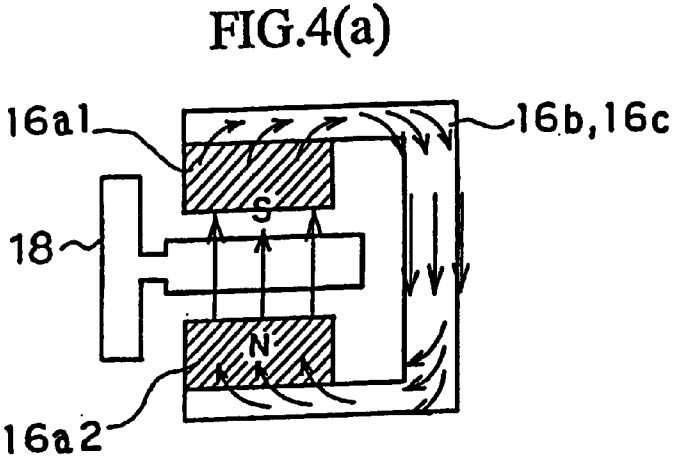
FIGS. 4(*a*) and 4(*d*) are schematic views showing details of a pickup apparatus of the governor.
Figure 4C:
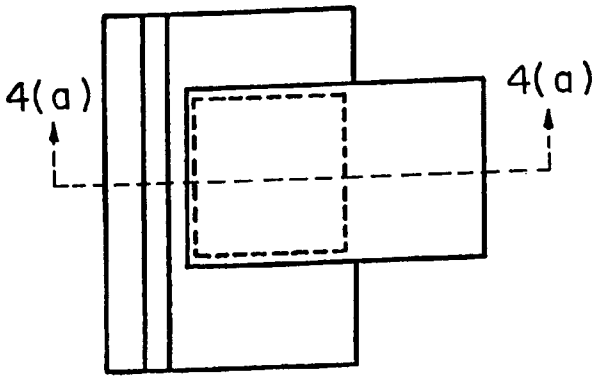
Figure 4D:
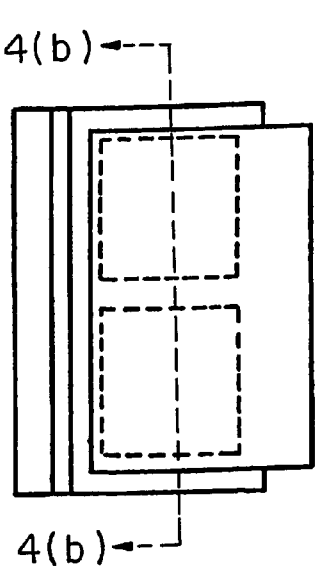
Figure 4B:
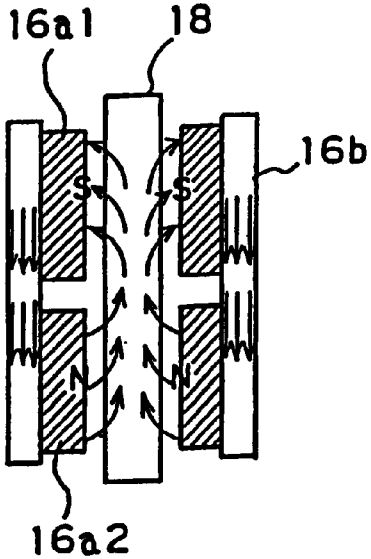

It is to be noted that, in order to reduce the friction at a contact between the one end of the latch arm 34 and the cam 32, a friction reduction mechanism 38 (cam latch mechanism) such as a bearing roller or a ball mechanism may be provided as shown in FIG. 3.

Reference numeral 55 denotes a hook (hook apparatus, emergency stop cancellation mechanism), and this hook 55 is connected to the holding down bar 35 via a hook pin 56. Reference numeral 57 denotes an unhooking pin (hook apparatus, emergency stop cancellation mechanism) mounted on the base 13.

It is to be noted that, in FIG. 2, a switch for disconnecting a power supply for a winding machine or the like, which moves the elevator upwardly and downwardly, when the speed of downward movement of the cage reaches a first over-speed (a switch corresponding to the cage stopping switch 20*a* described in the prior art (FIG. 24)) is omitted.

FIGS. 4(*a*) and 4(*b*) are schematic views showing details of the pickup of the governor. In the pickup 16, a magnetic circuit is composed of the magnets 16*a*, the back yokes 16*b* and 16*c* and the guide rail 18. While the magnets 16*a* and the guide rail 18 are located closely to each other, they do not contact with each other.

As an example of a construction of the magnetic circuit, for example, as shown in FIG. 4(*a*), a magnet 16*a*1 of the S pole is disposed on one side of the guide rail 18 while another magnet 16*a*2 of the N pole is disposed on the opposite side of the guide rail 18 to form a magnetic path along which magnetic fluxes return via the back yokes 16*b* and 16*c*.

As another example of a construction of the magnetic circuit, for example, as shown in FIG. 4(*b*), a magnet 16*a*1 of the S pole is disposed at an upper portion of the back yoke 16*b* on one side of the guide rail 18 while another magnet 16*a*2 of the N pole is disposed below the back yoke 16*b* such that a magnetic path is formed from the upper and lower magnets 16*a*1 and 16*a*2 on the back yoke 16*b* on the one side (only from the back yoke 16*b* on the one side) (in FIG. 4(*b*), two magnetic paths are formed from the upper and lower magnets 16*a*1 and 16*a*2 on the back yoke 16*b* on the opposite sides of the guide rail 18).

It is to be noted that the construction of the magnetic circuit need not be limited to those described above, and a magnetic path may naturally be formed only from the back yoke 16*b* on one side, and also the directions of the magnetic poles are not limited to those of the examples described above and the same poles may be opposed to each other (FIGS. 4(*c*) and 4(*d*) are side views of the pick of the governor shown in FIGS. 4(*a*) and 4(*b*), respectively or the different poles may be opposed to each other.

Figure 5B:
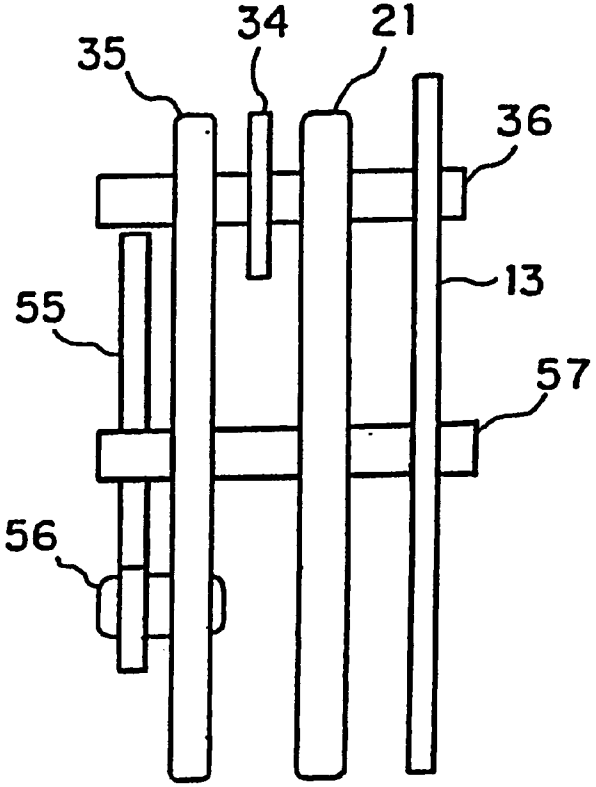
FIGS. 5(*a*) and 5(*b*) are enlarged schematic views showing details of a hook apparatus.
Figure 5A:
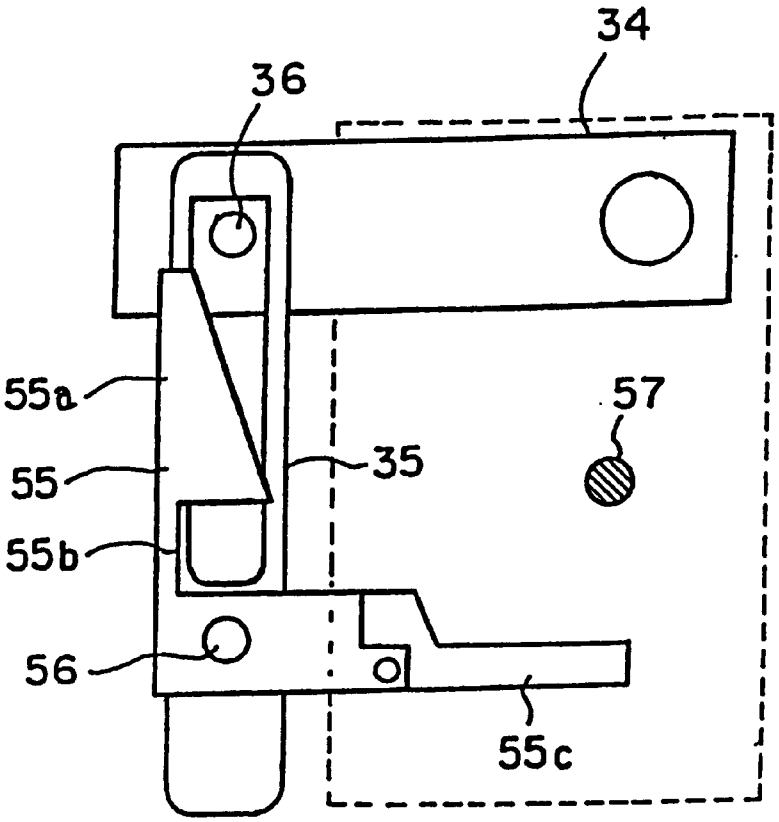

FIGS. 5(*a*) and 5(*b*) are enlarged schematic views (side and top views, respectively) showing details of the hook apparatus. Referring to FIGS. 5(*a*) and 5(*b*); reference numeral 55 denotes a hook, and this hook 55 is connected for pivotal motion in one direction (in the counterclockwise direction in FIGS. 5(*a*) and 5(*b*), that is, toward the guide rail 18 side) to the holding down bar 35 via the hook pin 56. Reference numeral 55*a* denotes a tapered portion which is an upper portion of the hook 55 and has a tapering configuration, and 55*b* a cutaway portion provided below the tapered portion 55*a* (intermediately of the hook 55). Reference numeral 55*c* denotes a projecting portion provided at a lower portion of the hook 55, and this projecting portion 55*c* is locked in one direction (upward direction) but can be pivoted in the opposite direction (downward direction). Reference numeral 57 denotes an unhooking pin (hook apparatus, emergency stop cancellation mechanism) securely mounted on the base 13. It is to be noted that overlapping description of common components denoted in FIGS. 5(*a*) and 5(*b*) by common reference numerals to those of FIG. 2 is omitted here.

Figure 6:
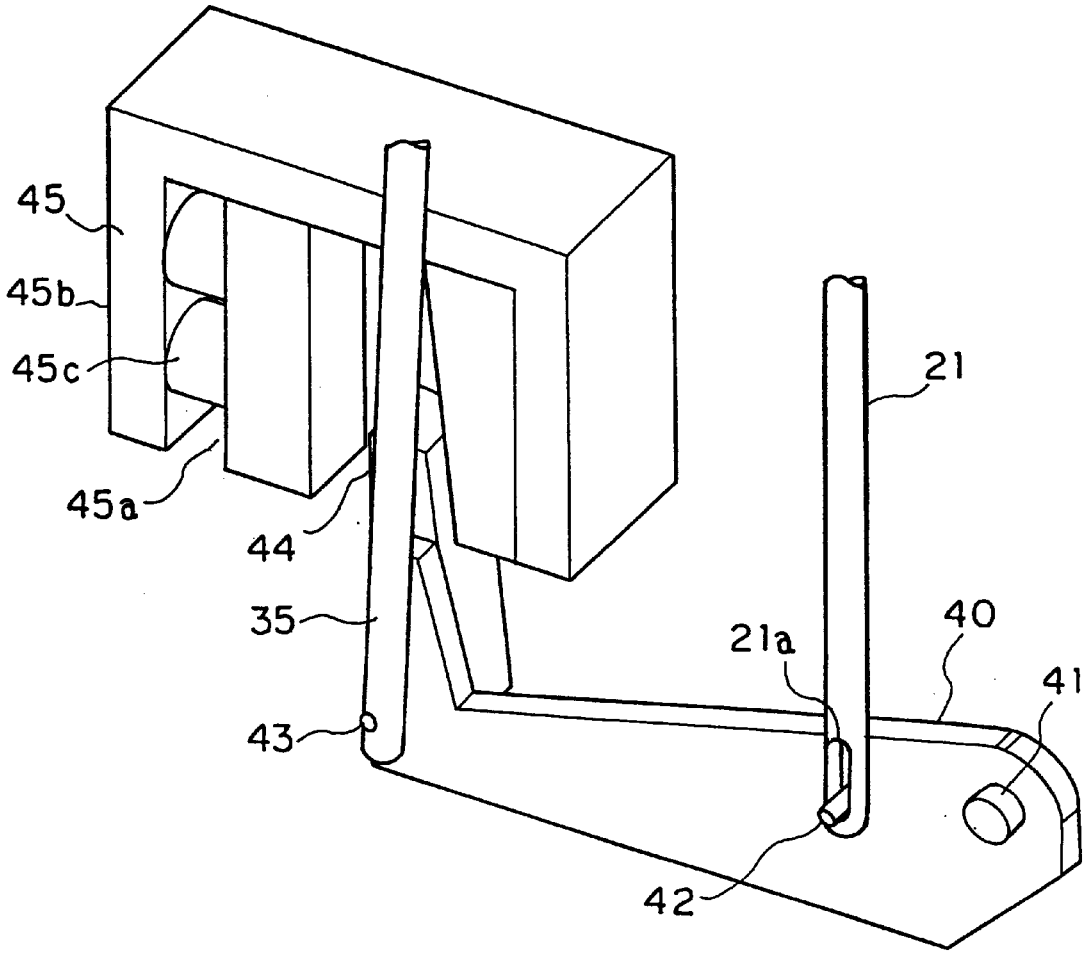
FIG. 6 is a perspective view showing a construction of an emergency stopping mechanism (and part of the emergency stop cancellation mechanism) (an enlarged view of a portion of FIG. 1 surrounded by another circle B)

FIG. 6 is a perspective view showing a construction of the emergency stopping mechanism and part of the emergency stop cancellation mechanism (an enlarged view of a portion of FIG. 1 surrounded by the circle B). Referring to FIG. 6, reference numeral 40 denotes an emergency stopping arm (emergency stopping mechanism), and the emergency stopping arm 40 is pivotally mounted at one end portion thereof on a support shaft 41 (rotary shaft, emergency stopping mechanism) secured to the cage frame 12 (or cage). Further, a pulling up pin 42 which is received in an elongated hole (pulling up bar) 21*a* provided at an end portion of the pulling up bar 21 is provided on the emergency stopping arm 40 in the proximity of the support shaft 41, and the holding down bar 35 is pivotally connected to the other end portion of the emergency stopping arm 40 (the end portion remote from the support shaft) by a holding down pin 43. Reference numeral 44 denotes an emergency stopping shoe (emergency stopping mechanism) provided at the other end portion of the emergency stopping arm 40, and 45 an emergency stopping biting metal member provided above the emergency stopping shoe 44. When the other end portion of the emergency stopping arm 40 is pivoted upwardly, the emergency stopping shoe 44 is brought into contact with the emergency stopping biting metal member 45 and the guide rail 18 and bites between the emergency stopping biting metal member 45 and the guide rail 18 by a wedging effect. As a result, a high braking force is generated by an effect of friction between them so that an emergency stopping operation may be performed. Reference numeral 45*a* denotes a joining portion of the emergency stopping biting metal member 45 to the emergency stopping shoe 44, 45*b* a frame of the emergency stopping biting metal member 45, and 45*c* an emergency stopping holding down spring interposed between the joining portion 45*a* and the frame 45*b*.

Figure 7:
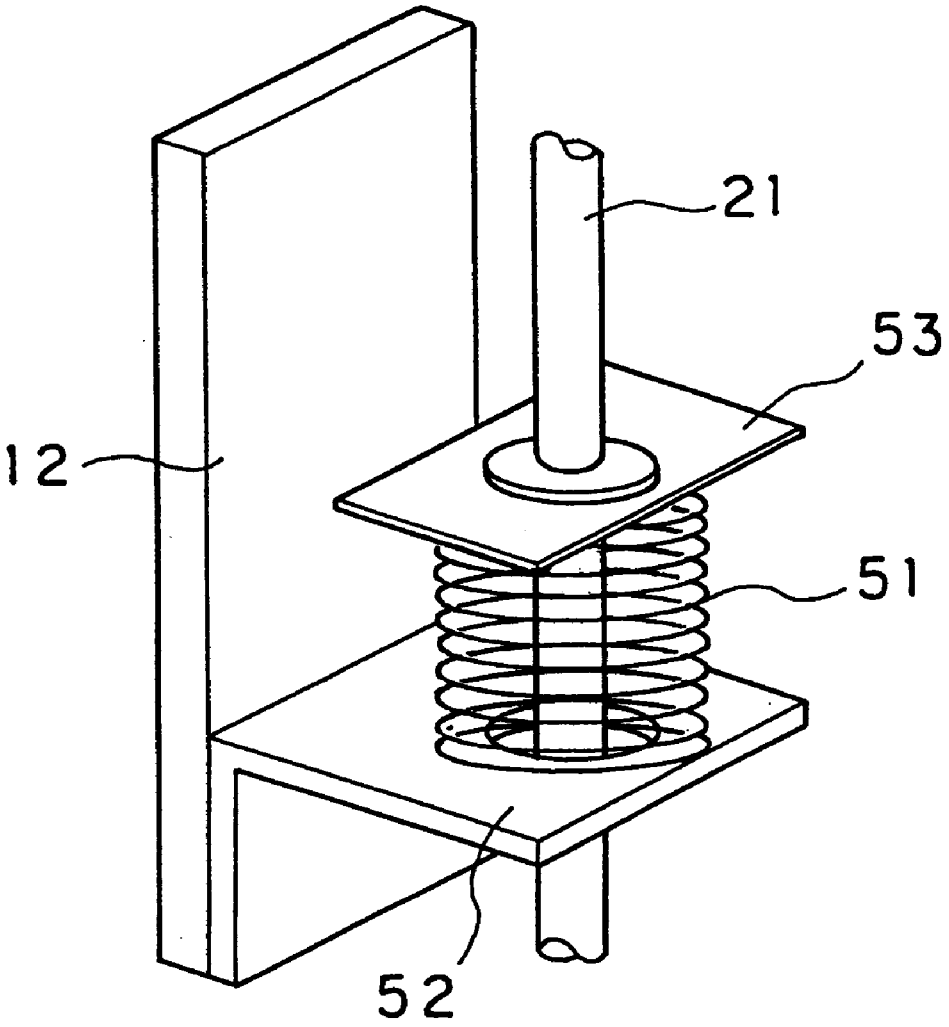
FIG. 7 is a perspective view showing a a construction of a spring apparatus.

FIG. 7 is a perspective view showing a construction of the spring apparatus. Referring to FIG. 7, reference numeral 51 denotes a pulling up spring, and 52 a spring base (spring apparatus, driving apparatus emergency stopping operation mechanism) securely mounted on the cage frame 12 of the elevator. The pulling up spring 51 is placed on a spring base 52. Further, the spring base 52 has a hole formed at a position thereof corresponding to the center of the pulling up spring 51 placed thereon, and the pulling up bar 21 extends through the hole and the pulling up spring 51. Reference numeral 53 denotes a spring holding down plate (spring apparatus, driving apparatus, emergency operation mechanism) secured to the pulling up bar 21, and the spring holding down plate 53 is biased upwardly by the pulling up spring 51.

Figure 8B:
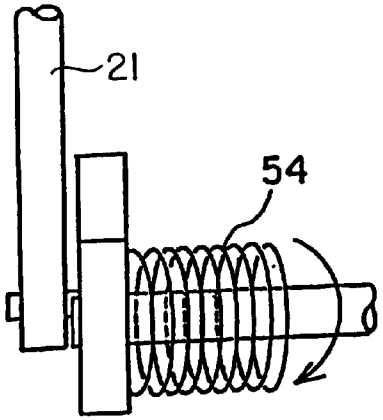
FIGS. 8(*a*) and 8(*b*) are schematic views showing a spring apparatus having a different construction from that of the spring apparatus of FIG. 7.
Figure 8A:
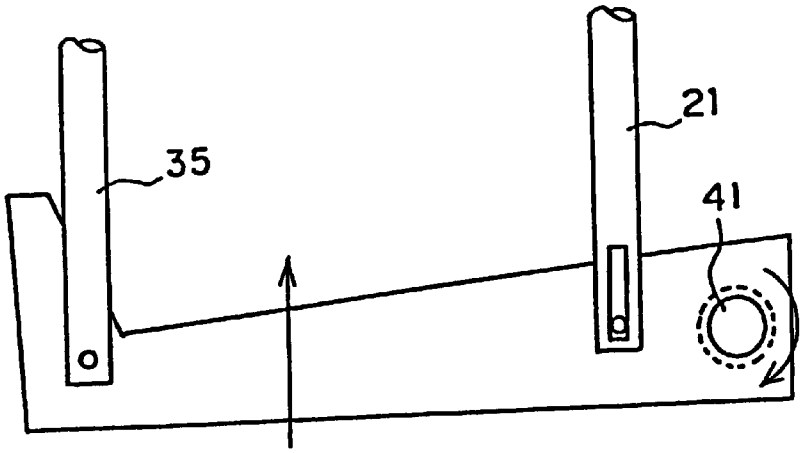

The spring apparatus described above is a mere example and may have a different construction. FIGS. 8(*a*) and 8(*b*) are schematic views of a spring apparatus having a different construction from that of the spring apparatus of FIG. 7. As shown in FIGS. 8(*a*) and 8(*b*) an emergency stopping arm pivoting arm 54 (spring apparatus, driving apparatus, emergency stopping operation mechanism) for applying a pivoting force in a direction to move the end of the emergency stopping arm 40 (the portion to which the holding down bar 35 and the emergency stopping shoe 44 are attached) upwardly (in the clockwise direction in FIG. 8) with respect to the support shaft 41 of the emergency stopping arm 40 is provided. The pulling up bar 21 can be biased upwardly also by the spring force (pivoting force) of the emergency stopping arm pivoting arm 54.

It is to be noted that the spring apparatus (driving apparatus) cooperates with the cam latch mechanism to construct the emergency stopping operation mechanism.

Subsequently, operation is described.

(1) First, operation of the governor and the cam latch mechanism is described with reference to FIGS. 2 and 4.

The pickup 16 has a magnetic circuit composed of the magnets 16*a* and the back yokes 16*b* and 16*c* (FIG. 4) and produces a magnetic field through the plane of the guide rail 18 located between the two magnets 16*a*1 and 16*a*2. When the cage frame 12 moves upwardly or downwardly and the magnetic field moves with respect to the guide rail 18, such eddy current as tends to cancel the variation of the magnetic field is generated in the guide rail 18 and a force (magnetic drag) having a magnitude corresponding to the speed of the cage frame 12 and acting in a direction to resist the movement of the cage frame 12 is generated with respect to the magnets 16*a*. This magnetic drag is transmitted to the governor arm 14, and this force is converted into a displacement in the upward or downward direction of the pickup 16 and the balance weight 17. By the displacement of the pickup 16 and balance weight 17, the main shaft 30 is rotated and the cam 32 attached to the one end of the main shaft 30 is rotated.

It is to be noted that, if the speed of downward movement of the cage frame 12 exceeds a predetermined value (first over-speed), then a cage stopping switch (not shown) operates in response to the downward displacement of the balance weight 17 so that the power supply to the elevator driving apparatus is interrupted and the cage frame 12 stops similarly as in the conventional safety apparatus for an elevator.

(2) Subsequently, an emergency stopping operation is described.

If the speed of downward movement of the cage frame 12 reaches a certain speed (second over-speed) by some cause, then the balance weight 17 is further displaced in response to this speed, and the main shaft 30 is rotated in response to the displacement of the balance weight 17. When the cam 32 attached to the one end of the main shaft 30 is rotated by the rotation of the main shaft 30, the latch arm 34 comes to the cutaway portion of the cam 32.

Figures 9A, 9B, 9C, 9D:
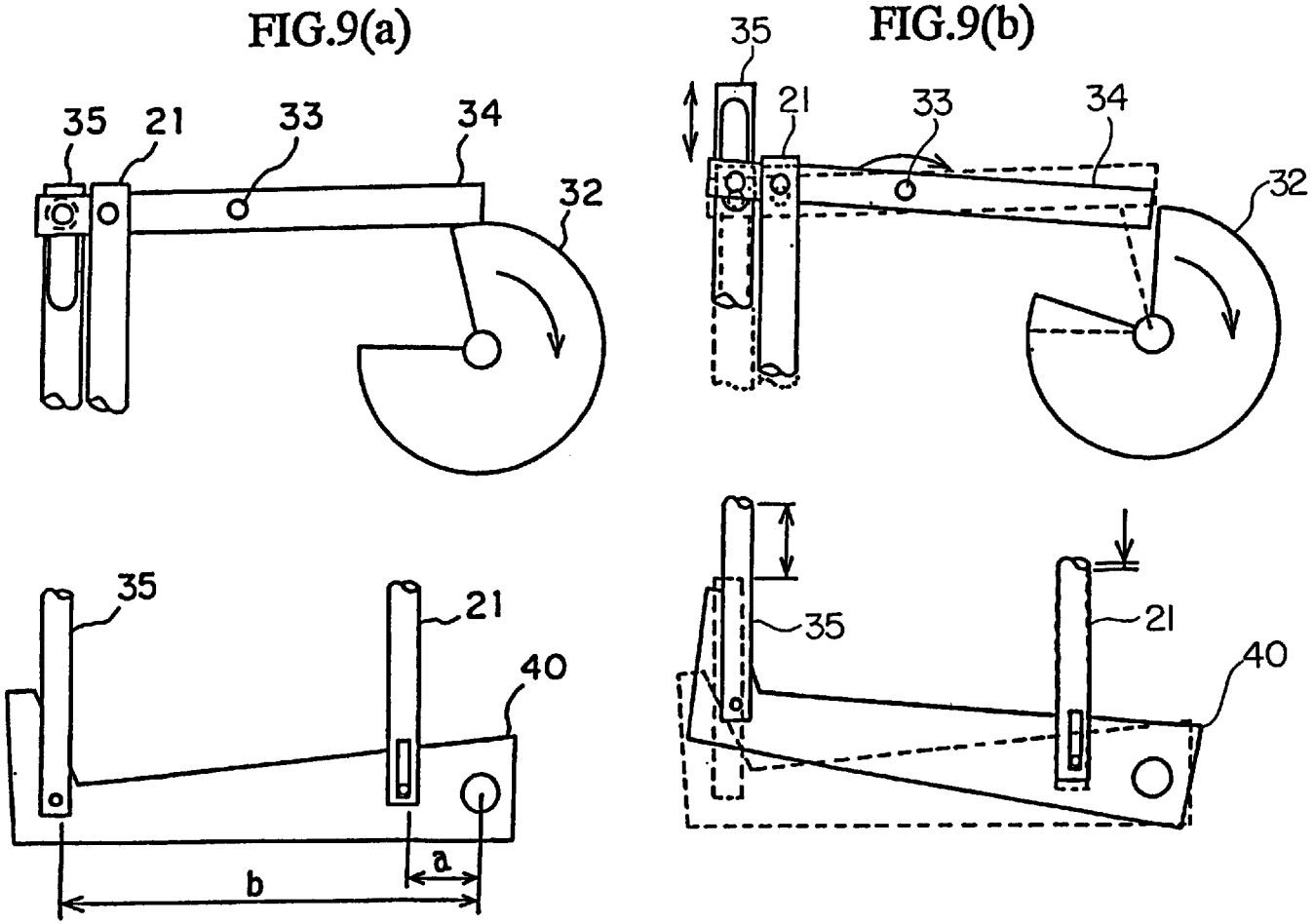
FIGS. 9(*a*) and 9(*b*) are views illustrating operation of a cam latch mechanism.

Here, since the upward biasing force of the pulling up spring 51 acts upon the other end portion of the latch arm 34 (at which the pulling up bar 21 is attached) via the pulling up bar 21 as seen in FIGS. 9(*a*) and 9(*c*) a downward force (in a direction to hold down the cam 32) acts upon the one end portion of the latch arm 34 (at which the latch arm 34 contacts with the cam 32) around the fulcrum provided by the latch pin 36. Accordingly, when the main shaft 30 rotates until the latch arm 34 comes to the cutaway portion of the cam 32 as seen in FIGS. 9(*b*) and 9(*d*) the downward force of the latch arm 34 which has been restrained till then is released, and the pulling up bar 21 is moved upwardly by the biasing force of the pulling up spring 51. As a result, also the emergency stopping arm 40 connected to the pulling up bar 21 is pushed upwardly (FIG. 6) so that the emergency stopping shoe 44 attached to the end portion of the emergency stopping arm 40 bites between the emergency stopping biting metal member 45 and the guide rail 18, whereupon a high braking force is generated by a frictional effect by them. Consequently, an emergency stopping operation is performed.

While also the emergency stopping arm 40 is pushed upwardly when the pulling up bar 21 moves upwardly as described above, also the holding down bar 35 attached to the end portion of the emergency stopping arm 40 is pushed upwardly simultaneously. While the pulling up bar 21 is provided in the proximity of the support shaft 41 of the emergency stopping arm 40, since the holding down bar 35 is provided at the end portion of the emergency stopping arm 40, the holding down bar 35 is displaced upwardly by a large amount by a small upward displacement of the pulling up bar 21. For example, where the distance between the pulling up bar 21 and the support shaft 41 is represented by a and the distance between the holding down bar 35 and the support shaft 41 is represented by b as seen in FIGS. 9(*a*) and 9(*d*), the holding down bar 35 is displaced upwardly by b/a times the distance over which the pulling up bar 21 moves upwardly.

On the other hand, the pulling up bar 21 and the holding down bar 35 are mounted substantially at same positions on the latch arm 34 by means of the latch pins 36. Here, since the holding down bar 35 is coupled at the elongated hole 35*a* thereof to the latch pin 36, it can move upwardly by an amount equal to the length of the elongated hole 35*a*. Accordingly, after the emergency stopping operation, since the displacement of the holding down bar 35 is larger than that of the pulling up bar 21 as described above, the holding down bar 35 projects upwardly by a large amount as seen in FIGS. 9(*b*) and 9(*d*).

Subsequently, a coupling operation of the hook is described.

When the emergency stop operates and the holding down bar 35 is pushed upwardly by the displacement by b/a times that of the pulling up bar 21 as described above, also the hook 55 connected to the holding down bar 35 by the hook pin 56 is pushed upwardly (FIGS. 5(*a*and 5(*b*)).

Figures 10A, 10B, 10C:
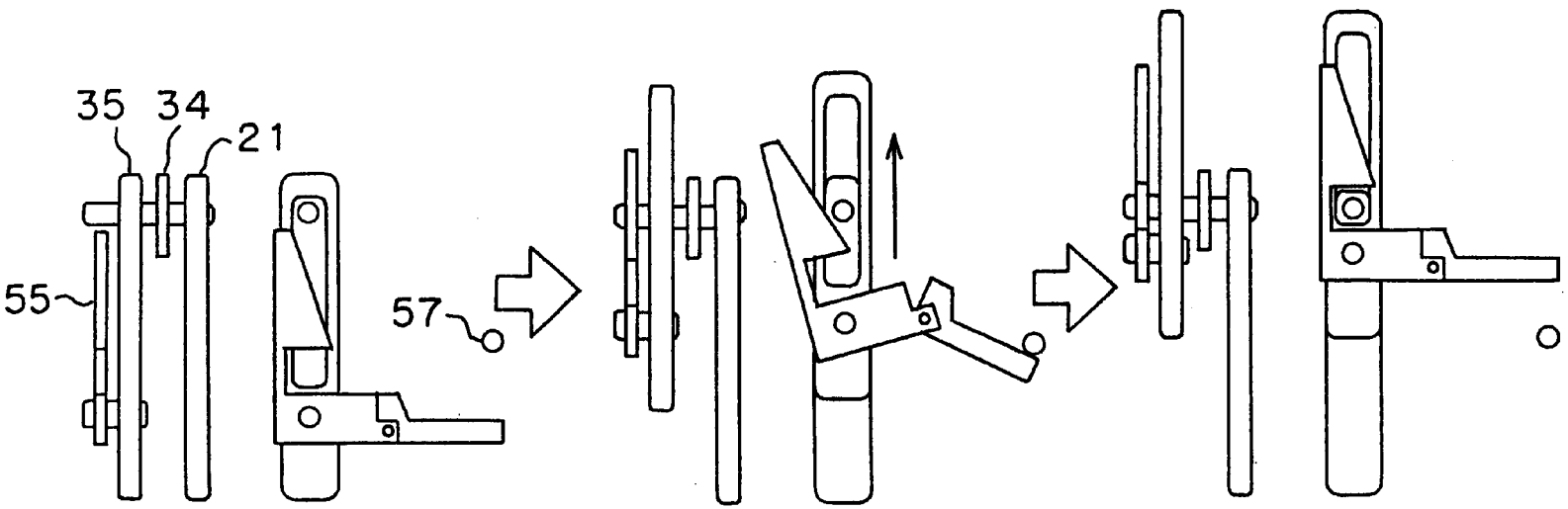
FIGS. 10(*a*) to 10(*c*) are schematic views illustrating an engaging operation of the hook.

FIGS. 10(*a*) to 10(*c*) are schematic views illustrating an engaging operation of the hook 55. In an initial state, that is, prior to an emergency stopping operation (FIG. 10(*a*)), both of the pulling up bar 21 and the holding down bar 35 are positioned at a substantially same position. However, in an emergency stopping operation, the holding down bar 35 is pushed up by a displacement of b/a times that of the pulling up bar 21, and the holding down bar 35 projects upwardly from the pulling up bar 21. Here, although also the hook 55 connected to the holding down bar 35 is pushed up together with the holding down bar 35, since the tapered portion 55*a* of a tapering configuration is provided at the upper portion of the hook 55, the hook 55 does not catch the latch pin 36 positioned above the hook 55. Further, since the projecting portion 55*c* provided at the lower portion of the hook 55 is adapted to be pivotable in the downward direction, it can pass by the unhooking pin 57 located above the projecting portion 55*c*. Then, when the hook 55 is further pushed up, the cutaway portion 55*b* of the hook 55 is engaged with the latch pin 36, thereby completing the coupling operation of the hook (FIG. 10(*c*)).

The emergency stopping operation is completed thereby.

(3) Subsequently, an emergency stop cancellation operation is described.

If the cage of the elevator is lifted upwardly by the winding machine or the like in order to cancel the emergency stop, then also the emergency stopping biting metal member 45 securely mounted on the cage (or cage frame) of the elevator is lifted simultaneously. When the emergency stopping biting metal member 45 is lifted, the biting state between the emergency stopping biting metal member 45 and the emergency stopping shoe 44 is cancelled by the restoring force of the emergency stopping holding down spring 45*c* in a compressed state and the frictional force between the guide rail 18 and the emergency stopping shoe 44. However, only if the biting state between the emergency stopping biting metal member 45 and the emergency stopping shoe 44 is cancelled, the pulling up bar 21 does not return to its initial state (in a state wherein the pulling up spring 51 is compressed and the latch arm 34 is lifted). Therefore, the emergency stop cancellation mechanism acts to return the pulling up bar 21 to the initial state.

Operation of the emergency stop cancellation mechanism is described.

In a state wherein the emergency stopping shoe 44 bites between the emergency stopping biting metal member 45 and the guide rail 18, the frictional force acts, and accordingly, the emergency stopping shoe 44 tends to stop itself but moves relatively downwardly. As a result, the emergency stopping arm 40 is pivoted in the downward direction. When the emergency stopping arm 40 is pivoted in the downward direction, also the holding down bar 35 is pulled downwardly. Here, since the hook 55 connected to the holding down bar 35 is held in engagement with the latch pin 36 as shown in FIG. 10(*c*) (engaged state of the hook 55), the pulling up bar 21 is pulled downwardly by a displacement amount equal to that of the holding down bar 35 under the restriction of the holding down bar 35 (it is to be noted that the reason why the pulling up bar 21 and the holding down bar 35 can be moved by an equal displacement amount is that the elongated hole 21*a* is provided at the end portion of the pulling up bar 21). Accordingly, the pulling up bar 21 moves by a displacement equal to b/a times that when it is pushed up (emergency stopping operation) and returns to its initial position after movement thereof over a distance shorter than the distance of the movement when it is pushed up, that is, over a short distance within which the frictional force between the emergency stopping shoe 44 and the guide rail 18 is maintained (the emergency stopping shoe 44 is maintained in a state wherein it bites between the emergency stopping biting metal member 45 and the guide rail 18). After the pulling up bar 21 returns to the position of the initial state, also the latch arm 34 moves upwardly. Thereupon, since the frictional force between the emergency stopping shoe 44 and the guide rail 18 is maintained, the cage frame 12 is operating at a low speed, and consequently, the governor arm 14 is being acted by a force to return the governor arm 14 to a horizontal position. Accordingly, when the latch arm 34 is pushed upwardly, the cam 32 rotates back to its initial position.

Figures 11A, 11B, 11C:
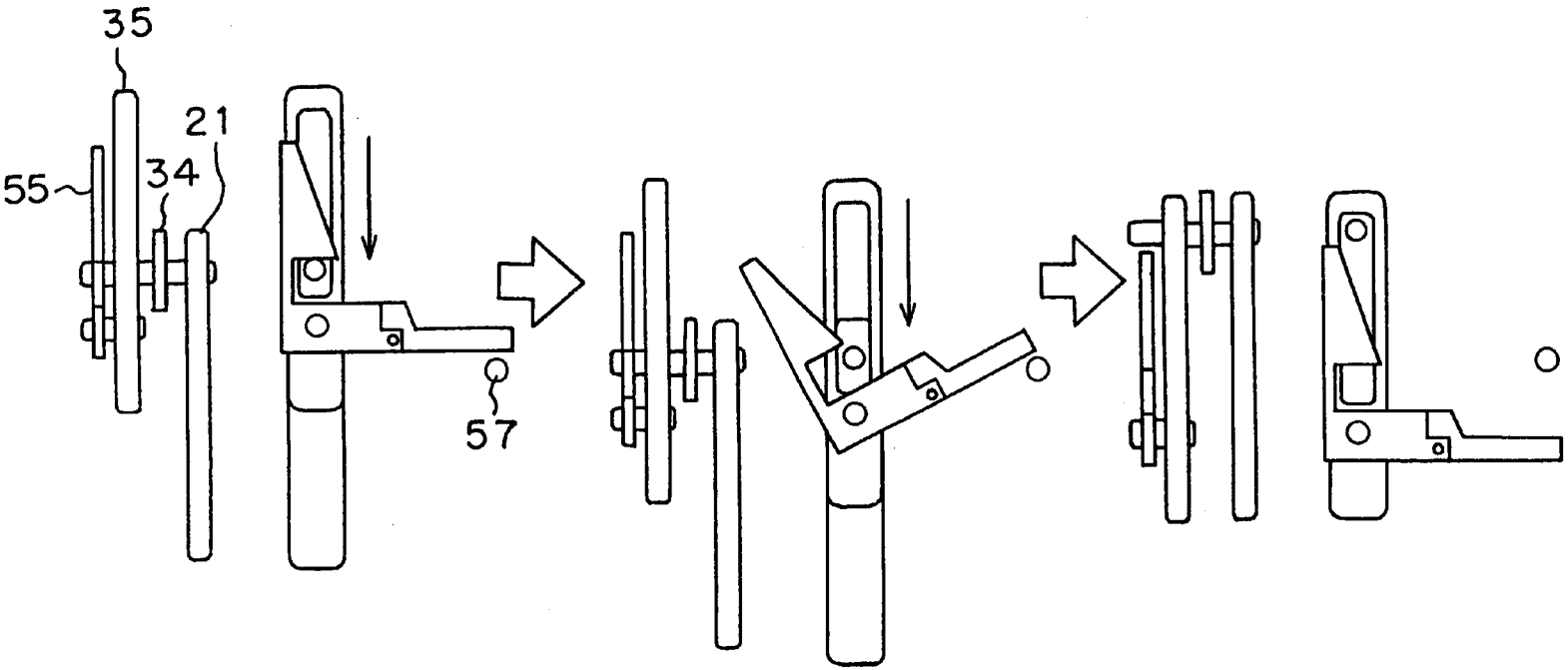
FIGS. 11(*a*) to 11(*c*) are schematic views illustrating a disengaging operation of the hook.

As the cage frame 12 further moves upwardly, the holding down bar 35 moves downwardly until the hook 55 reaches the position of the unhooking pin 57 and the unhooking pin 57 pivots the hook 55 (FIG. 11(*b*)). Consequently, the engagement between the hook 55 and the latch pin 36 is cancelled, and also the restriction of the pulling up bar 21 by the holding down bar 35 is cancelled. In this instance, since the latch arm 34 has already returned to its initial position, even if the restriction of the pulling up bar 21 is cancelled, the latch arm 34 is not pushed up by the biasing force of the pulling up spring 51.

As the cage frame 12 further moves upwardly until the emergency stopping shoe 44 and the guide rail 18 are disengaged from each other, the frictional force is removed, and the holding down bar 35 is pulled down to the last by the returning force of the emergency stopping holding down spring 45*c*. Consequently, all of the elements return to the initial positions (FIG. 11(*c*)).

In this manner, an emergency stopping operation and an emergency stop cancellation operation are performed by a difference in displacement between the locations on the emergency stopping arm 40 upon pivotal motion of the emergency stopping arm 40 and an operation of the hook 55. In particular, in an emergency stopping operation, the pulling up bar 21 pushes up the emergency stopping arm 40, and thereupon, the holding down bar 35 is pushed up by a stroke equal to b/a times the stroke of the pulling up bar 21. On the contrary, in an emergency stop cancellation operation, the holding down bar 35 is pushed down together with the emergency stopping arm 40, and thereupon, also the pulling up bar 21 is pulled down by a stroke equal to that of the holding down bar 35 (action of the hook 55).

It is to be noted that, while this Embodiment 1 employs the cam 32, it is characterized in that a displacement of the pickup 16 triggers an emergency stopping operation, and any other mechanism may be employed only if it releases a pulling-up pre-pressure.

It is to be noted that, while, in the safety apparatus for an elevator of Embodiment 1 described above, the governor, cam latch mechanism, emergency stopping mechanism, driving apparatus, emergency stop cancellation mechanism and so forth are provided on the cage frame 12, they need not be provided on the cage frame 12, but may be provided on any movable component of the elevator such as the cage or weight. This similarly applies to the other embodiments which are hereinafter described.

As described above, according to this Embodiment 1, since an emergency stopping operation is triggered by a governor and a cam latch mechanism while a driving force for performing the emergency stopping operation is generated from a resilient member such as a spring and an emergency stop cancellation operation is performed by a hook apparatus, even if the magnetic drag generated by eddy current is low and the pulling up force of the governor when an over-speed is detected is low, the emergency stopping operation can be performed using the pulling up force of the governor as a trigger. Consequently, malfunctions can be reduced, and the emergency stopping mechanism can be returned to its initial state readily only by raising the cage.

Embodiment 2

Figure 12B:
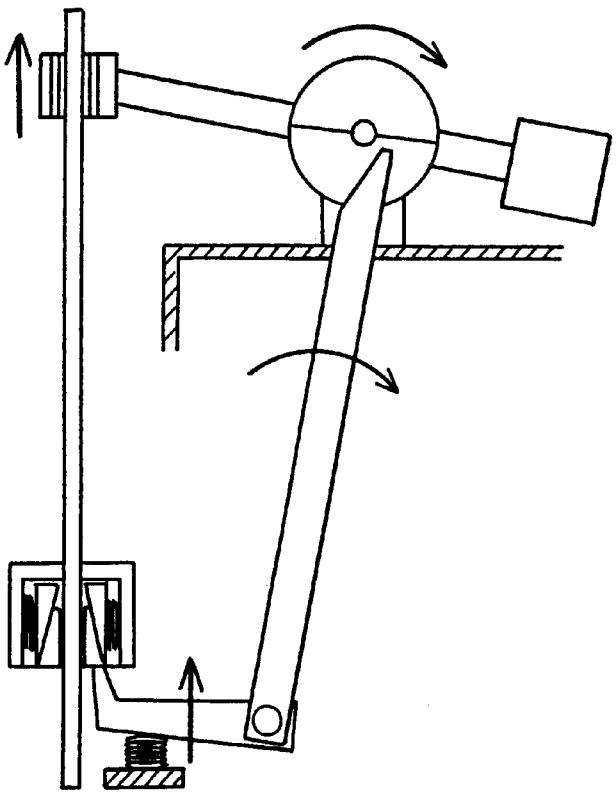
FIGS. 12(*a*) and 12(*b*) are views showing a construction of a safety apparatus for an elevator according to Embodiment 2 of the present invention.
Figure 12A:
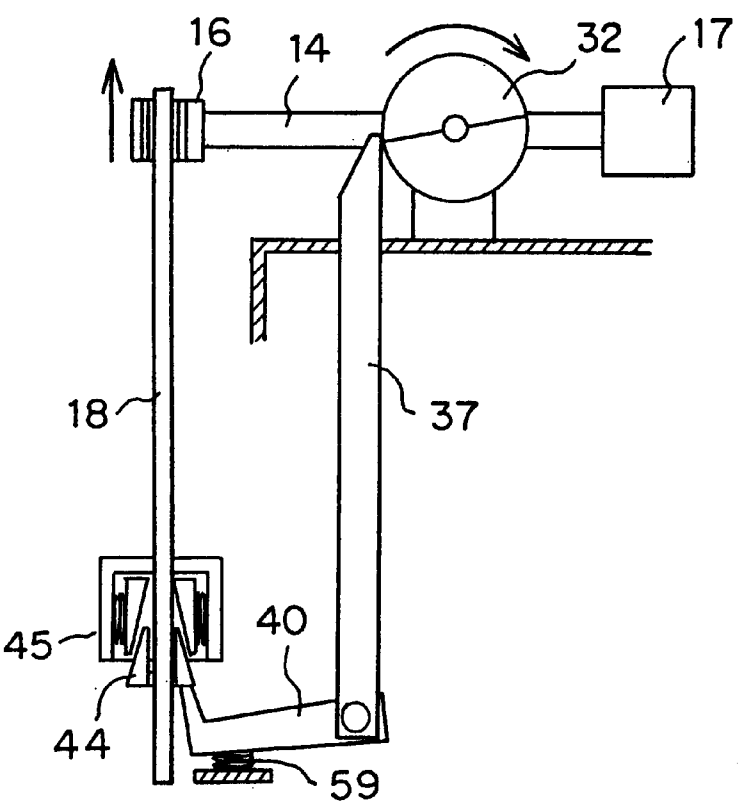

FIGS. 12(*a*) and 12(*b*) are views showing a construction of a safety apparatus for an elevator according to Embodiment 2 of the present invention. Referring to FIGS. 12(*a*) and 12(*b*), reference numeral 37 denotes a latch arm, and one end portion of the latch arm 37 contacts with a cam 32 while the other end portion of the latch arm 37 is directly connected for pivotal motion to an emergency stopping arm 40. Reference numeral 59 denotes a pulling up spring (spring apparatus, driving apparatus, emergency stopping operation mechanism) disposed below the emergency stopping arm 40 for biasing the emergency stopping governor arm 40 upwardly.

Figure 13:
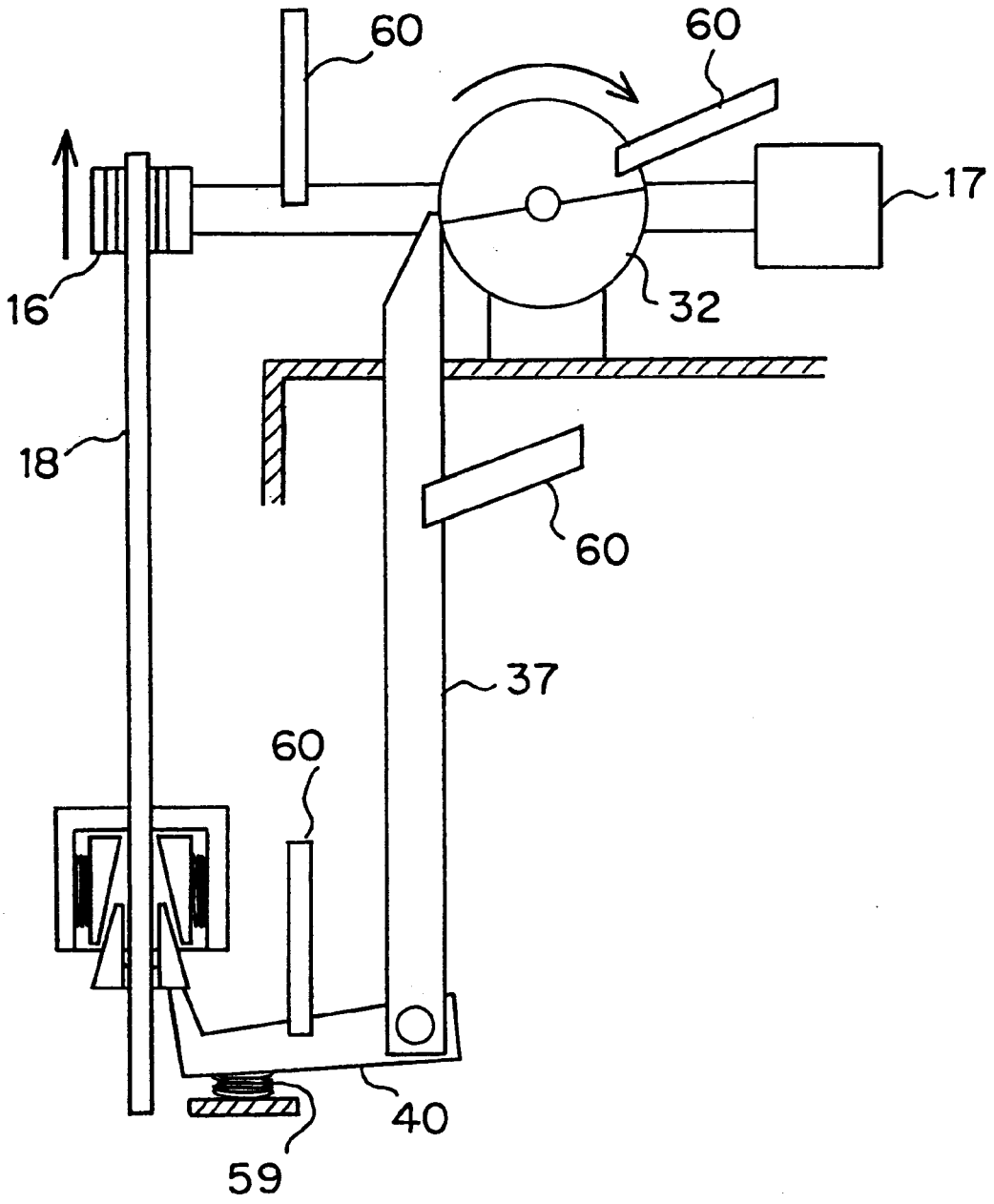
FIG. 13 is a view illustrating an emergency stop cancellation operation of the safety apparatus for an elevator according to Embodiment 2 of the present invention.
Figure 14A:
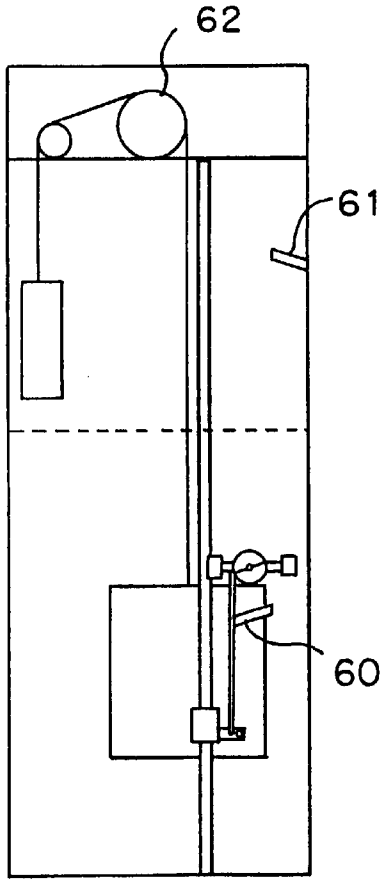
FIGS. 14(*a*) to 14(*d*) are schematic views illustrating an emergency stop cancellation operation different from the emergency stop cancellation operation illustrated in FIG. 13.
Figure 14B:
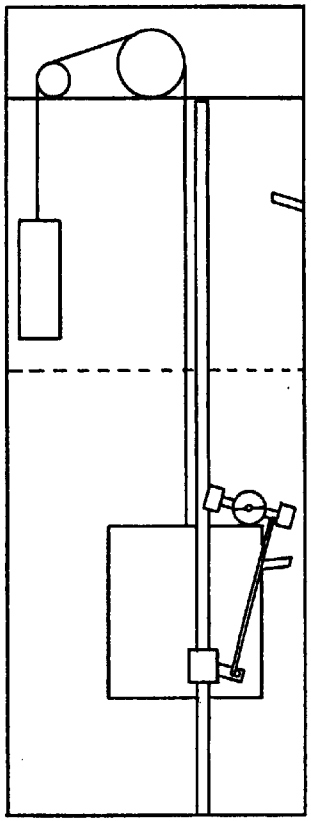
Figure 14C:
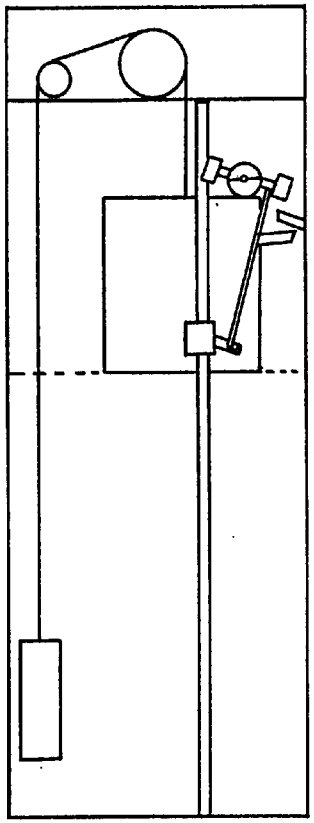
Figure 14D:
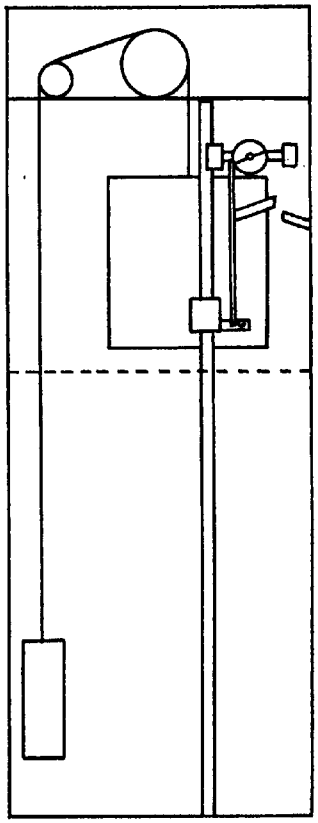
Figure 15A:
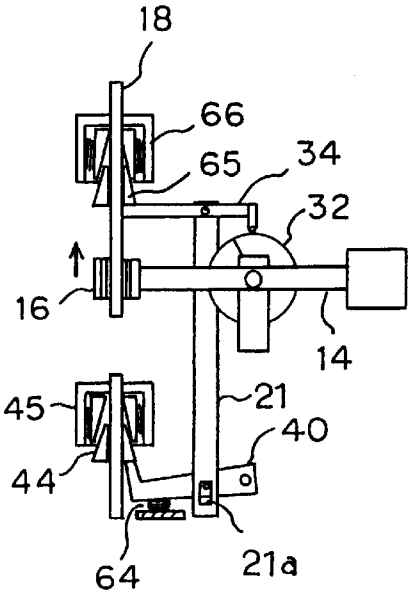
FIGS. 15(*a*) to 15(*d*) are views illustrating a construction and operation of a safety apparatus for an elevator according to Embodiment 3 of the present invention.
Figure 15B:
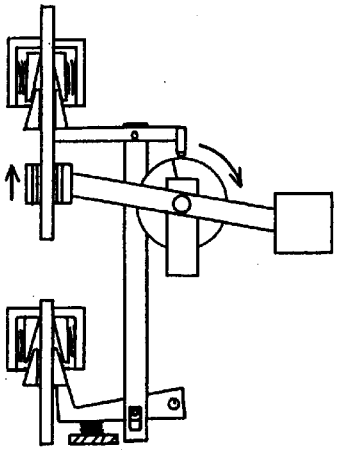
Figure 15C:
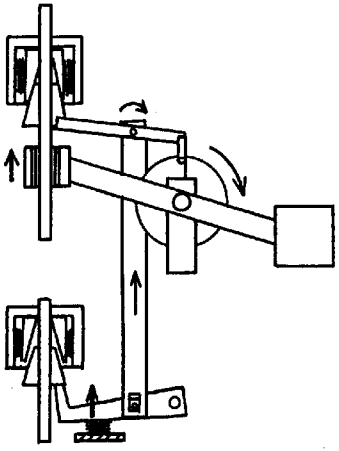
Figure 15D:
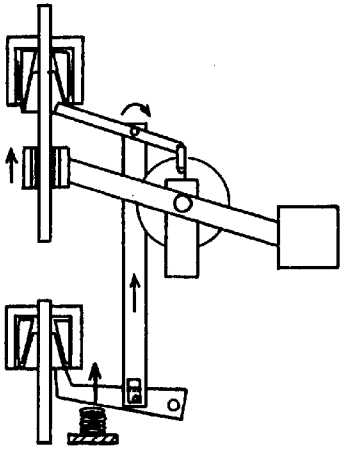
Figure 16A:
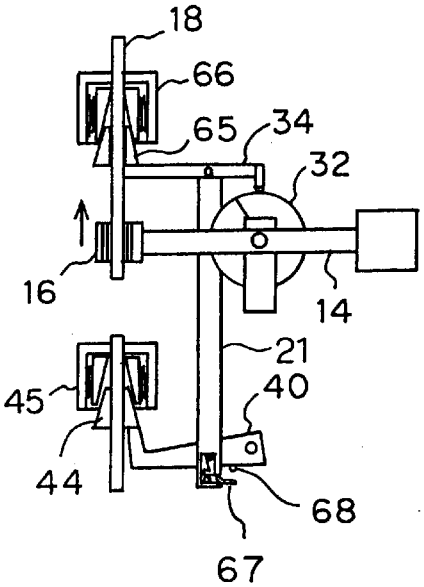
FIGS. 16(*a*) to 16(*d*) are schematic views of a safety apparatus for an elevator which employs an emergency stop cancellation mechanism different from that shown in FIGS. 15(*a*) to 15(*d*)
Figure 16B:
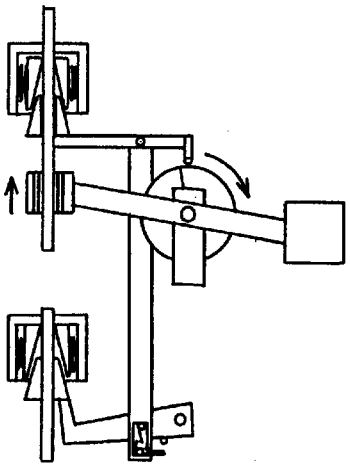
Figure 16C:
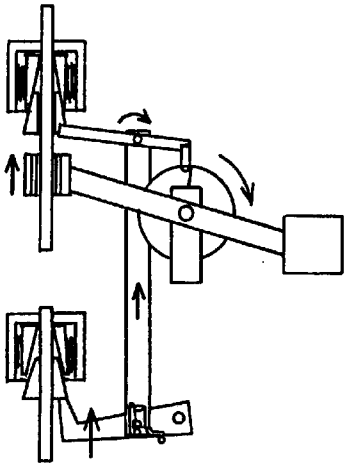
Figure 16D:
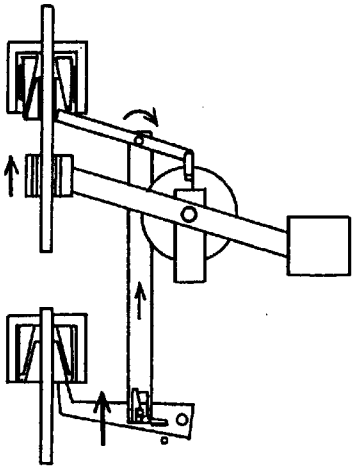

FIG. 13 is a schematic view illustrating an emergency stop cancellation operation of the safety apparatus for an elevator shown in FIGS. 12(*a*) and 12(*b*). Referring to FIG. 13, reference numeral 60 denotes a cancellation arm (emergency stop cancellation mechanism) provided on an arm 14, the cam 32, the latch arm 37 and (or) the emergency stopping arm 40.

It is to be noted that, in FIGS. 12(*a*), 12(*b*) and 13, those elements denoted by same reference numerals as those of Embodiment 1 (FIGS. 2 and 6) described above are same or corresponding elements as or to those of Embodiment 1 described above, and therefore, overlapping description of them is omitted here.

Incidentally, in FIGS. 12(*a*), 12(*b*) and 13, in order to facilitate understanding of operation, the front face (direction of the latch arm 37) and the emergency stopping face (direction of the emergency stopping arm 40) of the cam 32 which originally extend perpendicularly to each other as shown in FIG. 1 are shown on the same plane. Also in FIGS. 14 to 24 which are hereinafter described, the front face and the emergency stopping face of the cam 32 are shown in the same plane in order to facilitate understanding of operation.

Subsequently, operation is described.

An emergency stopping operation is described.

While, in Embodiment 1 described above, the latch arm 34 and the emergency stopping arm 40 are operatively associated with each other by the pulling up bar 21 and the holding down bar 35, in this Embodiment 2, the latch arm 37 and the emergency stopping arm 40 are directly connected for pivotal motion to each other.

As shown in FIGS. 12(*a*) and 12(*b*), the latch arm 37 is, in an ordinary state, biased in an emergency stopping operation direction (upward direction) by the pulling up spring 59 (FIGS. 12(*a*)). If the latch arm 37 which is in contact with the cam 32 is released as a result of rotation of the cam 32, then the latch arm 37 is pivoted so that the emergency stopping arm 40 connected to the latch arm 37 is pivoted upwardly. Consequently, the emergency stopping shoe 44 provided at the end portion of the emergency stopping arm 40 bites between the emergency stopping biting metal member 45 and the guide rail 18 so that an emergency stopping operation is performed.

Subsequently, an emergency stop cancellation operation is described.

FIG. 13 is a view illustrating an emergency stop cancellation operation of the safety apparatus for an elevator according to Embodiment 2 of the present invention.

In order to cancel the emergency stopping operation after it comes to an end, the cage frame 12 of the elevator is lifted slowly in a direction (upward direction) to eliminate the frictional force (braking force) of the emergency stopping shoe 44 by means of the winding machine (it is to be noted that, while the cage frame 12 can be moved upwardly, the emergency stopping shoe 44 remains in the engaged state, and at this point of time, the emergency stop is not fully cancelled). Then, on the nearest floor, the door is opened, and the cancellation arm 60 is manually operated using an arm for moving the cancellation arm 60 or the like from the entrance side to fully cancel the emergency stopping operation.

FIGS. 14(*a*) to 14(*d*) are schematic views illustrating an emergency stop cancellation operation different from the emergency stop cancellation operation illustrated in FIG. 13. Referring to FIG. 13, reference numeral 61 denotes a cancellation cam (emergency stop cancellation mechanism) disposed in a lifting path of the elevator. The cancellation cam 61 is engaged with the cancellation arm 60 so that an emergency stop cancellation operation can be performed only by lifting the cage frame 12 by a winding machine 62.

As described hereinabove, when the speed of movement of the cage frame 12 reaches the second over-speed, the emergency stopping mechanism operates (FIG. 14(*a*)). When the emergency stopping mechanism operates, the latch arm 37 is tilted and the cancellation arm 60 provided on the latch arm 37 is projected outwardly from the cage frame 12 (FIG. 14(*b*)). If the cage frame 12 is pulled upwardly in this state, then the cancellation arm 60 is engaged with the cancellation cam 61 provided on the lifting path (FIG. 14(*c*)). When the cage frame 12 is further lifted, the cancellation arm 60 is pushed into the cage frame 12. As a result, also the latch arm 37 returns to its initial state, and the emergency stop cancellation mechanism returns to its initial position (FIG. 14(*d*)).

As described above, according to this Embodiment 2, since the latch arm 37 is directly connected to the emergency stopping arm 40, the overall construction of the safety apparatus for an elevator is simplified. While an emergency stop cancellation operation is performed manually, also this operation can be performed readily. Further, if the cancellation arm 60 and the cancellation cam 61 are provided, then it is also possible to automatically perform emergency stop cancellation.

Embodiment 3

While, in Embodiment 1 described hereinabove, while, in Embodiment 1 described above, an emergency stopping operation at a second over-speed is triggered by a governor and a cam latch mechanism while a driving force for performing the emergency stopping operation is generated from a spring apparatus and an emergency stop cancellation operation is performed by a hook apparatus, in this Embodiment 3, an emergency stopping operation at a second over-speed is triggered by a governor and a cam latch mechanism while a driving force for performing the emergency stopping operation is generated by a pulling up wedge mechanism provided on a pickup and an emergency stop cancellation operation is realized by a pulling down spring.

FIGS. 15(*a*) to 15(*d*) are views illustrating a construction and operation of the safety apparatus for an elevator according to Embodiment 3 of the present invention. Referring to FIGS. 15(*a*) to 15(*d*), reference numeral 65 denotes a pulling up shoe (pulling up wedge mechanism) provided at an end portion of a latch arm 34 (at an end portion remote from the end portion at which the latch arm 34 contacts with a cam 32), and 66 a pulling up biting metal member (pulling up wedge mechanism) provided above the pulling up shoe 65. When the latch arm 34 is pivoted to move the end portion thereof upwardly, the pulling up shoe 65 is contacted with the pulling up biting metal member 66 and a guide rail 18 and bites between the pulling up biting metal member 66 and the guide rail 18 by a wedging effect. As a result, a high braking force is generated by a frictional effect between them so that an emergency stopping operation is performed. Reference numeral 64 denotes a pulling down spring (emergency stop cancellation mechanism) for pulling the emergency stopping arm 40 downwardly. Reference numeral 21 denotes a pulling up bar (link apparatus) for connecting the latch arm 34 and the emergency stopping arm 40 to each other.

It is to be noted that those elements denoted by same reference numerals to those of Embodiment 1 or 2 (FIGS. 2 and 6 or 12) described above are same or corresponding elements, and overlapping description of them is omitted here.

Subsequently, operation is described.

First, an emergency stopping operation is described.

When the cage frame 12 is moving at an ordinary operation speed, the governor arm 14 is in a horizontal position, but when the speed of downward movement of the cage frame 12 drops, then the governor arm 14 is tilted and the cam 32 is rotated (FIG. 15(*b*)). Further, when the cage frame 12 reaches the second over-speed (or exceeds the second over-speed), the cam 32 is further rotated and the end portion of the latch arm 34 (end portion at which the latch arm 34 contacts with the cam 32) reaches the cutaway portion of the cam 32. Thereupon, the latch arm 34 is inclined, and the pulling up shoe 65 provided at the other end portion of the latch arm 34 is pulled up and bites into the pulling up biting metal member 66 (FIG. 15(*c*)). Thereupon, a high braking force is generated by a frictional effect between them. Consequently, the latch arm 34 and the pulling up bar 21 are pulled up by a strong force to activate the emergency stopping mechanism (FIG. 15(*d*)). It is to be noted that the pin engaging portion of the pulling up bar 21 is in the form of the elongated hole 21*a* so that, upon operation, the downward force of the emergency stopping mechanism may not have an influence until the second over-speed is reached, and when the second over-speed is reached, the pulling up shoe 65 bites into the pulling up biting metal member 66 more readily.

Subsequently, an emergency stop cancellation operation is described.

If the cage frame 12 is lifted, then the emergency stopping arm 40 is pulled down in a direction (downward direction) to release the emergency stopping mechanism by the pulling down spring 64, the frictional force between the emergency stopping shoe 44 and the emergency stopping biting metal member 45 is lost and an emergency stop cancellation operation is performed. Also the pulling up wedge mechanism is released similarly. Here, since the cam 32 tends to return to its horizontal position if the cage frame 12 is moving at a low speed, also the cam 32 returns to its initial position.

FIGS. 16(*a*) to 16(*d*) are schematic views of a safety device for an elevator which employs an emergency stop cancellation mechanism different from that of FIG. 15. Referring to FIGS. 16(*a*) and 16(*b*), reference numeral 67 denotes a hook (hook apparatus, emergency stop cancellation mechanism) provided at a lower end of the pulling up bar 21. Reference numeral 68 denotes an unhooking pin (emergency stop cancellation mechanism).

It is to be noted that elements denoted by same reference numerals to those of FIG. 15 are same or corresponding elements, and overlapping description of them is omitted here.

Subsequently, operation is described.

An emergency stopping operation is described.

First, when the cage frame 12 is moving in an ordinary operation speed, the governor arm 14 is in a horizontal position (FIG. 16(*a*)). However, if the speed of downward movement of the cage frame 12 drops, then the pickup 16 is displaced in the upward direction and the pulling up shoe 65 provided on the pickup 16 approaches the pulling up biting metal member 66. When the cage frame 12 reaches (or exceeds) the second over-speed, the pulling up shoe 65 is brought into contact with the pulling up biting metal member 66 and bites between the pulling up biting metal member 66 and the guide rail 18 by friction (FIG. 16(*b*)). Thereupon, also the pulling up bar 21 mounted on the governor arm 14 is lifted, and the hook 67 provided at the lower end of the pulling up bar 21 is engaged with the pulling up pin 42 (FIG. 16(*b*)). After the pulling up bar 21 moves until the pulling up pin 42 comes to an end of the elongated hole 21*a*, it pulls up the emergency stopping arm 40 by a strong pulling up force caused by a wedging action to establish an emergency stopping operation state (FIG. 16(*c*)), and the emergency stopping operation is completed by the wedging action of the emergency stop (FIG. 16(*d*)).

It is to be noted that, since the emergency stop cancellation operation is similar to the emergency stop cancellation operation described above in connection with Embodiment 1 in which the hook 55 is used, operation thereof is omitted here.

As described above, according to this Embodiment 3, the force which is applied to the cam 32 upon ordinary operation can be reduced, and also the force of the emergency stopping operation is high. Further, also the emergency stop cancellation operation can be performed simply. In particular, since, in Embodiment 1 described hereinabove, the pulling up force is derived from a biasing force of the pulling up spring 51, a strong force from the latch arm 34 is always applied to the cam 32. However, according to Embodiment 2, since the pulling up force is derived from a wedging action of the pulling up wedge mechanism, only a spring force which converts the magnetic drag to the pickup 16 into a displacement in the direction of pivotal motion is applied only to the cam 32, and the friction between the cam 32 and the latch arm 34 is reduced and also the stability of the cam latch mechanism is improved.

Further, since an over-speed is detected from the displacement of the pickup 16 and the pulling up wedge mechanism is activated using the cam latch mechanism as a trigger, only if the pickup 16 is precise, accurate detection of an over-speed can be achieved. Consequently, the accuracy of the mechanism can be moderated and also the safety is improved.

Furthermore, since the emergency stop cancellation mechanism is formed from the pulling down spring 64 or the hook 67, an emergency stop cancellation operation can be performed readily and with certainty only by lifting the cage.

Embodiment 4

In this Embodiment 4, a safety apparatus for an elevator is realized by providing a pulling up wedge mechanism on a pickup 16.

Figures 17A, 17B, 17C, 17D, 17E:
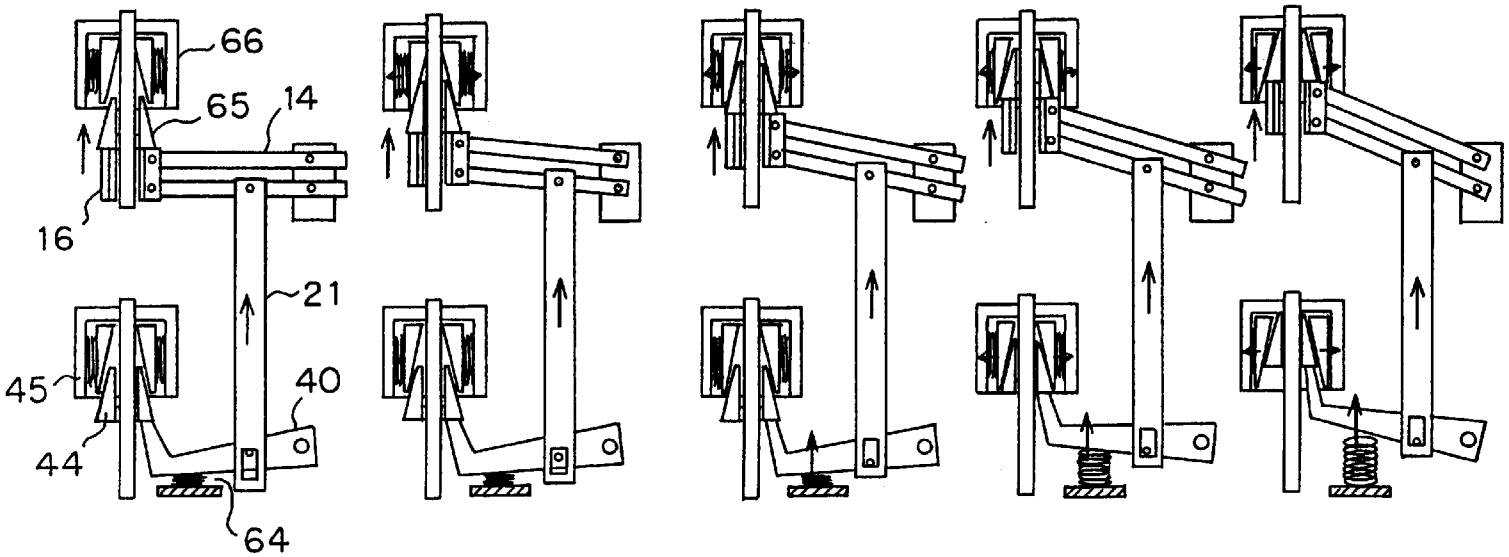
FIGS. 17(*a*) to 17(*e*) are views illustrating a construction and operation of a safety apparatus for an elevator according to Embodiment 4 of the present invention.
Figure 18A:
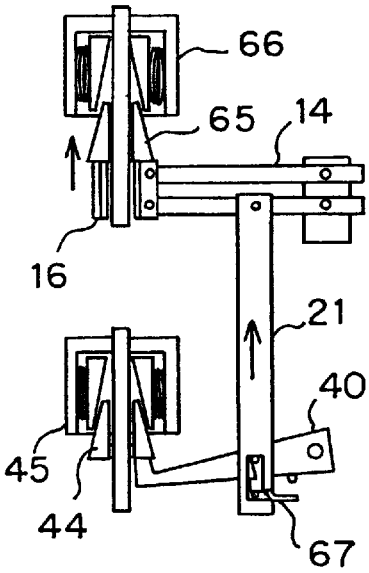
FIGS. 18(*a*) to 18(*e*) are schematic views illustrating an emergency stopping operation of an emergency stop cancellation mechanism of the safety apparatus for an elevator of FIGS. 17(*a*) to 17(*e*) which is performed by a hook apparatus.
Figure 18B:
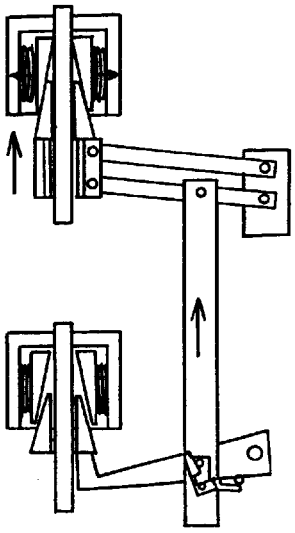
Figure 18C:
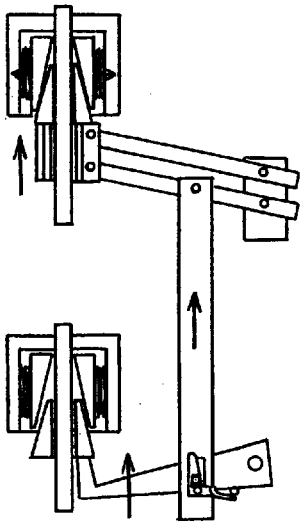
Figure 18D:
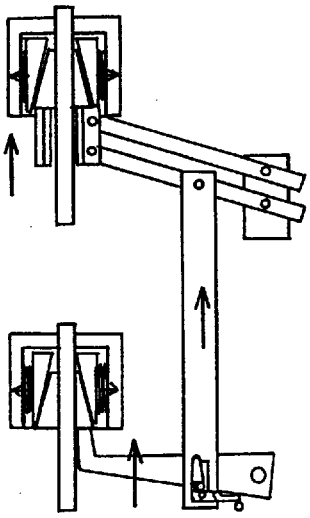
Figure 18E:
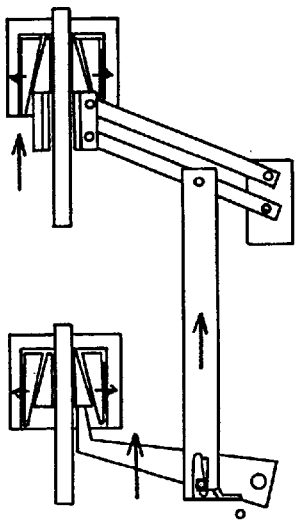
Figure 19A:
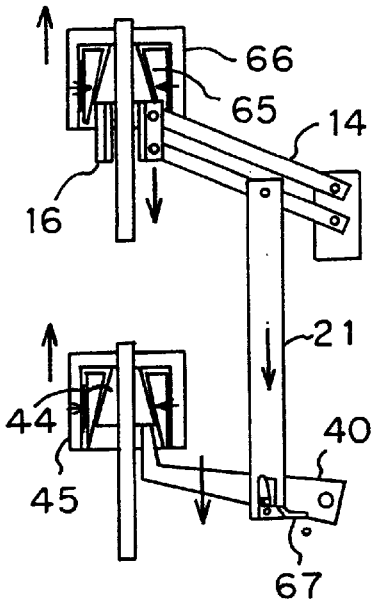
FIGS. 19(*a*) to 19(*e*) are schematic views illustrating an emergency stop cancellation operation of the emergency stop cancellation mechanism of the safety apparatus for an elevator of FIGS. 17(*a*) to 17(*e*) which is performed by the hook apparatus.
Figure 19B:
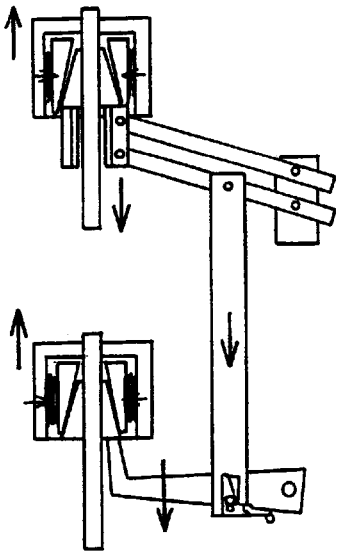
Figure 19C:
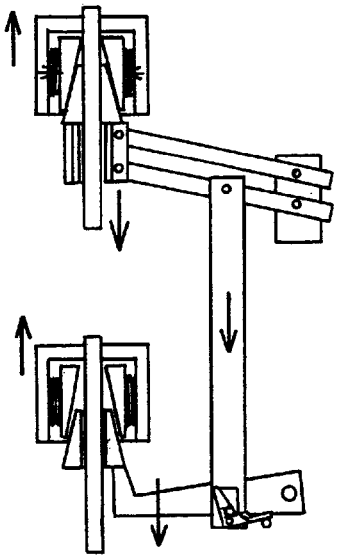
Figure 19D:
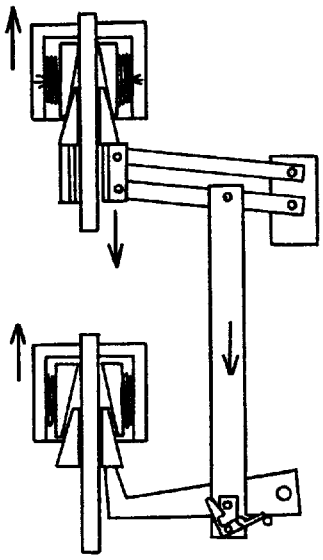
Figure 19E:
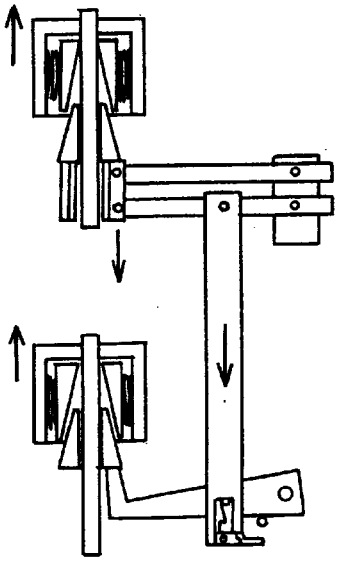

FIGS. 17(*a*) to 17(*e*) are views illustrating a construction and operation of the safely apparatus for an elevator according to this Embodiment 4 of the present invention. In FIGS. 17(*a*) to 17(*e*), those elements denoted by same reference numerals to those of Embodiments 1 to 3 described above are same or corresponding elements, and overlapping description of them is omitted here.

While, in Embodiment 3 described above, the pulling up shoe 65 is provided at an end portion of the latch arm 34, in this Embodiment 4, the pulling up shoe 65 for extracting a pulling up force by a wedging action is provided on the pickup 16, and the pulling up biting metal member 66 secured to the cage frame 12 side by a biting metal member base (not shown) is disposed above the pulling up shoe 65. Further, the pickup 16 is connected to the emergency stopping mechanism via the pulling up bar 21. Furthermore, the emergency stopping arm 40 undergoes a pulling down force at a position of an initial state by the pulling down spring 64.

Subsequently, operation is described.

An emergency stopping operation is described.

First, when the cage frame 12 is moving at an ordinary operation speed, the governor arm 14 is in a horizontal position (FIG. 17(*a*)). However, if the speed of downward movement of the cage frame 12 drops, then the pickup 16 is displaced upwardly and the pulling up shoe 65 provided on the pickup 16 approaches the pulling up biting metal member 66 (FIG. 17(*b*)). Further, when the speed of the cage frame 12 reaches the second over-speed (or exceeds the second over-speed), then the pulling up shoe 65 is brought into contact with the pulling up biting metal member 66 and bites between the pulling up biting metal member 66 and the guide rail 18 by friction (FIG. 17(*c*)). A contacting face of the pulling up biting metal member 66 with the pulling up shoe 65 is acted upon by a substantially fixed, for example, spring force in a direction to widen the wedge, and consequently, a strong pulling up force by the wedging action can be held to a substantially fixed force. After the pulling up bar 21 moves until the pulling up pin 42 comes to an end of the elongated hole 21*a*, the emergency stopping arm 40 is pulled up by the strong pulling up force arising from the wedging action to enter an emergency stopping operation state (FIG. 17(*d*)), and the emergency stopping operation is completed by the wedging action of the emergency stop (FIG. 17(*e*)).

It is to be noted that description of the emergency stop cancellation operation is omitted here because it is similar to that in Embodiment 3 described above.

While the safety apparatus for an elevator apparatus shown in FIGS. 17(*a*) to 17(*e*) performs an emergency stop cancellation operation by means of the pulling down spring 64, this can be performed by a hook apparatus.

FIGS. 18(*a*) to 18(*e*) and 19(*a*) to 19(*e*) are schematic views of a safety apparatus for an elevator wherein an emergency stop cancellation operation is performed by a hook apparatus. FIGS. 18(*a*) to 18(*e*) illustrate an emergency stopping operation, and FIGS. 19(*a*) to 19(*e*) illustrate an emergency stop cancellation operation.

It is to be noted that description of the emergency stopping operation and the emergency stop cancellation operation is omitted here since they are similar to the emergency stopping operation illustrated in FIG. 17 and the emergency stop cancellation operation in Embodiment 3 described above, respectively.

As described above, according to this Embodiment 4, since a pulling up wedge mechanism is provided on the pickup 16, the overall construction of the safety apparatus for an elevator is simplified and the emergency stopping operation can be activated by a high pulling up force due to a wedging action of the pulling up wedge mechanism. Further, an emergency stop cancellation operation can be performed readily only by lifting the cage.

Embodiment 5

FIGS. 20(*a*) and 20(*d*) are views showing a construction of a safety apparatus for an elevator according to Embodiment 5 of the present invention. Referring to FIGS. 20(*a*) and 20(*b*), reference 47 denotes an emergency stop base (emergency stopping mechanism) on which an emergency stopping biting metal member 45 is mounted. The emergency stop base 47 is constructed such that the emergency stopping biting metal member 45 is disposed above an emergency stopping shoe 44 provided on a pickup 16. It is to be noted that those elements denoted by same reference numerals as those of Embodiments 1 to 4 and the prior art described hereinabove are same or corresponding elements and overlap- ping description thereof is omitted here.

Subsequently, an emergency stopping operation is described.

If the speed of the cage frame 12 reaches the second over-speed, then the pickup 16 moves upwardly, and also the pickup 16 provided on the pickup 16 moves upwardly. Then, the emergency stopping shoe 44 bites between the emergency stopping biting metal member 45 and the guide rail 18 disposed above the pickup 16 with the emergency stop base 47 interposed therebetween, whereupon a high frictional force is generated to effect emergency stopping of the elevator.

Figure 21B:
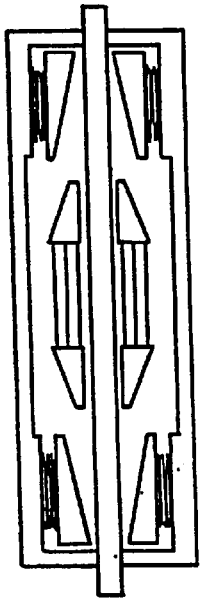
FIGS. 21(*a*) and 21(*b*) are views showing a construction of a safety apparatus for an elevator wherein emergency stopping mechanism are provided above and below a pickup.
Figure 21A:
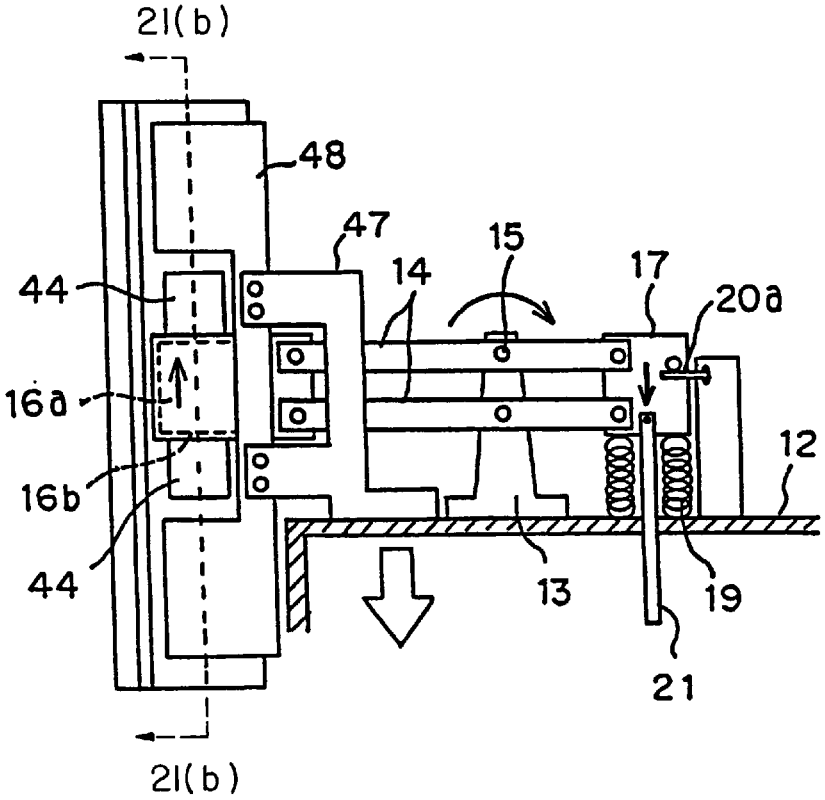

FIGS. 21(*a*) and 21(*b*) are views showing a construction of the safety apparatus for an elevator wherein emergency stopping mechanisms are provided above and below the pickup 16. Referring to FIG. 21, reference 48 denotes an emergency biting metal member (emergency stopping mechanism), and the emergency biting metal member 48 is constructed such that it covers above and below the pickup 16 so that the emergency stopping shoes 44 provided above and below the pickup 16 may bite into the emergency stopping shoe 44.

By providing the emergency stopping mechanisms above and blow the pickup 16 in this manner, emergency stopping of the elevator can be performed in whichever of the upward and downward directions the elevator is moving.

As described above, according to this Embodiment 5, since the emergency stopping shoe 44 is provided on the pickup 16 and the emergency stopping biting metal member 45 is disposed above (and below) the pickup 16 with the emergency stop base 47 interposed therebetween, the pulling down bar 21, the holding down bar 35, the pulling up wedge mechanism and so forth become unnecessary and an emergency stopping operation can be performed directly by a displacement of the pickup 16, and the safety apparatus for an elevator can be constructed readily in a further reduced size. Further, since the emergency stopping mechanism is disposed on the cage frame 12, installation adjustment can be performed readily and also inspection and maintenance are facilitated.

Embodiment 6

Figure 22:
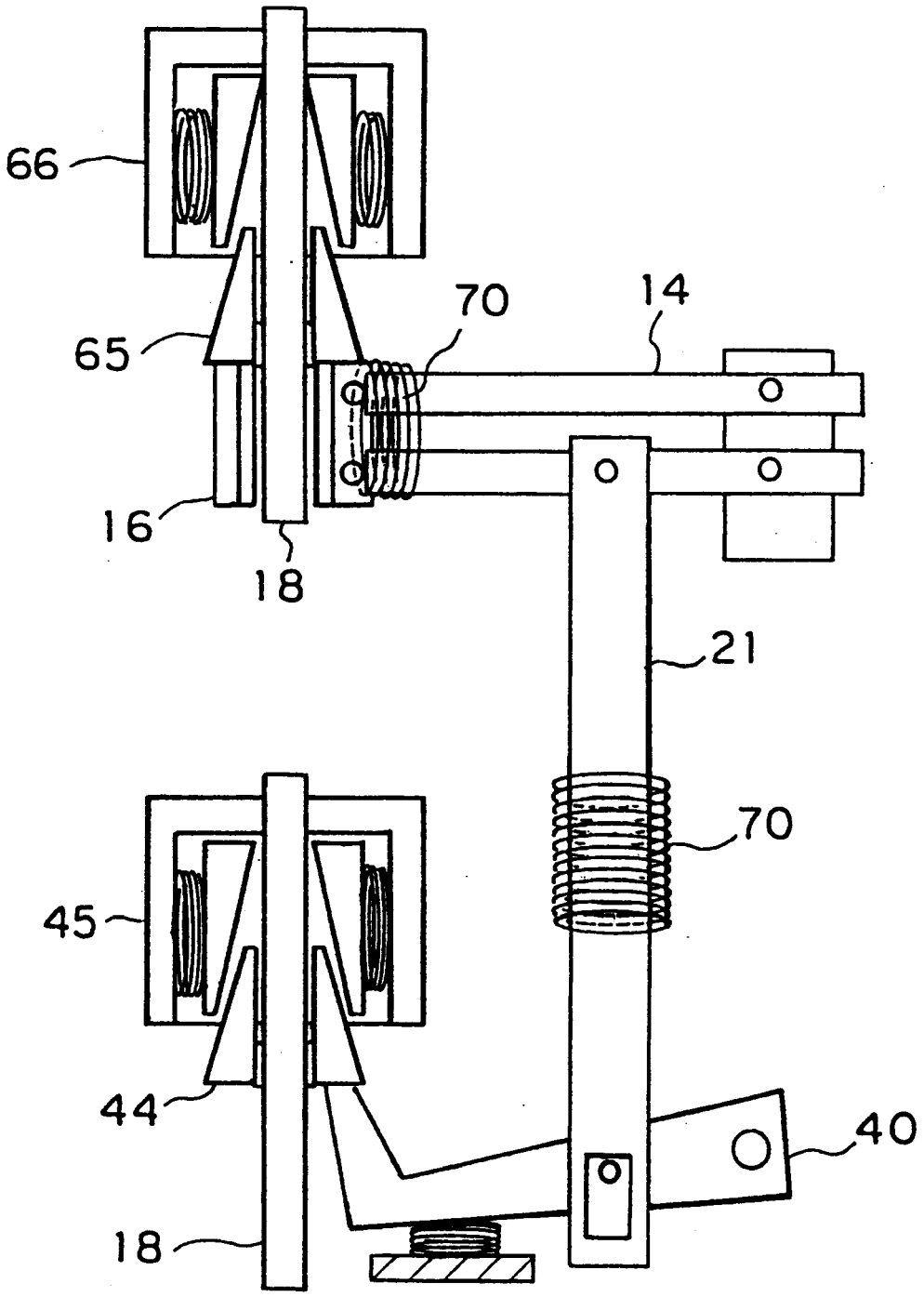
FIG. 22 is a view showing a construction of a safety apparatus for an elevator according to Embodiment 6 of the present invention.

FIG. 22 is a view showing a construction of a safety apparatus for an elevator according to Embodiment 6 of the present invention. Referring to FIG. 22, reference numeral 70 denotes an oscillation absorption element provided between a pickup 16 and a governor arm 14, intermediately of a pulling up bar 21 or (and) on an emergency stopping arm 40. It is to be noted that, in FIG. 22, those elements denoted by same reference numerals as those of Embodiment 4 (FIG. 17) described above are same or corresponding elements and overlapping description of the same is omitted here.

If the cage is oscillated upwardly and downwardly by oscillations of the cage when the cage moves or by passengers getting into or out of the cage or moving violently in the cage, then also the speed of the cage oscillatorily varies by a large amount and there is the possibility that the emergency stop may operate in error. Therefore, by providing the oscillation absorption element 70 as shown in FIG. 22, oscillations of the cage can be absorbed to reduce the possibility that an operation in error may take place. The oscillation absorption element 70 is formed from a resilient member such as a spring or rubber, and the mounted position of the oscillation absorption element 70 may be a location other than that shown in FIG. 22 and the oscillation absorption element 70 may be provided at any location of the governor, the emergency stopping operation mechanism or the emergency stopping mechanism.

It is to be noted that, if the oscillation absorption element 70 is set so as to have an oscillation frequency lower than an oscillation frequency to be absorbed (for example, if it is assumed that the oscillation frequency of the cage when passengers move violently in the elevator is, for example, 5 Hz, then the primary resonance frequency by the resilient member of the safety apparatus where the resilient member (oscillation absorption element 70) is added is the oscillation frequency of 5 Hz to be absorbed) (for example, the oscillation frequency of the oscillation absorption element 70 is set to approximately 2 Hz), then the oscillation absorption element 70 acts as a physically hard solid member within a range of the frequency up to the primary resonance frequency. Accordingly, since, in such an abnormal state that a critical speed is reached as a result of dropping of the cage or because the cage becomes uncontrollable, the cage varies but not oscillatorily, that is, in a low frequency, in such a state that the critical speed is reached, the resilient member exhibits a characteristic near to that of a rigid member and the elevator can be emergency stopped with certainty without a time delay. On the other hand, an oscillatory input which arises in such a case that passengers move violently in the cage can be absorbed because it is low in frequency.

Embodiment 7

While, in the conventional safety apparatus for an elevator, a counterweight is provided in order to establish a balanced state with the pickup 16 which forms a magnetic circuit, there is the possibility that an over-speed may not be detected accurately by mere provision of the counterweight because, if the emergency stopping mechanism (pulling up bar 21, emergency stopping arm 40, emergency stopping shoe 44 and so forth) is mounted, then the force is biased in one direction and the balance of the pulling up force by eddy current is lost. Further, since the overall operation mechanism section (governor, cam latch mechanism, emergency stopping mechanism, emergency stop cancellation mechanism and so forth) is not in a well-balanced state, there is the possibility that the governor may be displaced by an influence of oscillations applied to the cage frame 12 or the like to cause the emergency stopping mechanism to malfunction.

Thus, in this Embodiment 7, the overall operation mechanism section is put into a well-balanced state to achieve stabilized operation.

Figure 23B:
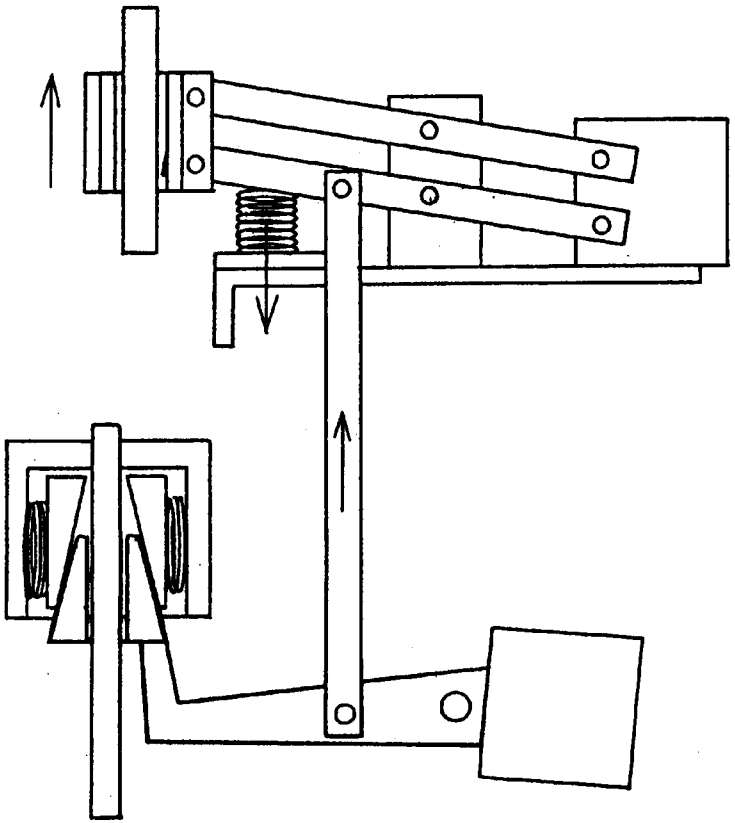
FIGS. 23(*a*) and 23(*b*) are views illustrating a construction and operation of a safety apparatus for an elevator according to Embodiment 7 of the present invention.
Figure 23A:
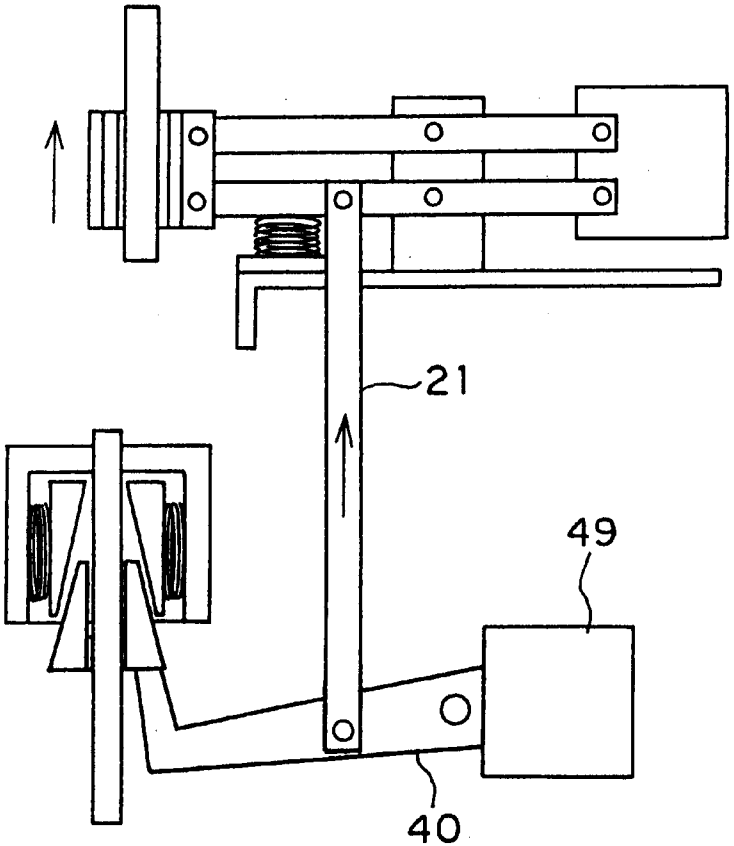

FIGS. 23(*a*) and 23(*b*) are views illustrating a construction and operation of a safety apparatus for an elevator according to Embodiment 7 of the present invention. Referring to FIGS. 23(*a*) and 23(*b*), reference 49 denotes an auxiliary weight provided in the rear of a support shaft 41 for an emergency stopping arm 40. The auxiliary weight 49 is adjusted so that the overall operation mechanism section in an initial position may be in a well-balanced state (state prior to an emergency stopping operation). For example, in the safety apparatus for an elevator shown in FIG. 22, principal components provided so as to be balanced with the balance weight 17 are the pickup 16, governor arm 14, pulling up bar 21, emergency stopping arm 40 and emergency stopping shoe 44, and the weight of the auxiliary weight 49 is adjusted so that a well-balanced condition may be provided between those elements.

It is to be noted that, in FIGS. 23(*a*) and 23(*b*), those elements denoted by same reference numerals as those of Embodiments 1 to 6 described above are same or corresponding elements and overlapping description of them is omitted here.

Subsequently, operation is described.

First, when the cage frame 12 is moving at an ordinary operation speed, the governor arm 14 is in a horizontal position (FIG. 23(*a*)). However, if the speed of downward movement of the cage frame 12 rises, the pickup 16 is displaced upwardly and the emergency stopping arm 40 is pulled up. Here, since the balance of the overall optician mechanism section is adjusted using the auxiliary weight 49 as described above, when the second over-speed is reached, the safety apparatus for an elevator operates accurately. If the speed of the cage frame 12 reaches the second over-speed (or exceeds the second over-speed), then the emergency stopping shoe 44 is brought into contact with the emergency stopping biting metal member 45 and bites between the emergency stopping biting metal member 45 and the guide rail 18 by friction (FIG. 23(*b*)). It is to be noted that a contacting face of the emergency stopping biting metal member 45 with the emergency stopping shoe 44 is acted upon by a substantially fixed, for example, spring force in a direction in which the wedge is widened, and a strong pulling up force by a wedging action can be kept to a substantially fixed force. Then, the emergency stopping arm 40 is pulled up by the strong pulling up force arising from the wedging action and an emergency stopping operation state is entered, and the emergency stopping operation is completed by the wedging action of the emergency stop.

It is to be noted that description of the emergency stop cancellation operation is omitted here because it is similar to that of Embodiment 1 described hereinabove.

As described above, according to this Embodiment 7, since the auxiliary weight 49 is mounted at an end portion of the emergency stopping arm 40, the overall operation mechanism section can be adjusted so as to be in a well-balanced state, and such a situation that the governor is displaced by an influence of oscillations applied to the cage frame 12 or the like and the emergency stop operates in error is reduced.

As described above, according to the first aspect of the present invention, since a safety apparatus for an elevator comprises a guide rail of a conductor securely disposed along a path of upward and downward movement of the elevator, an emergency stopping mechanism mounted on a movable section of the elevator for gripping the guide rail to generate a frictional force to brake the movable section, a governor mounted on the movable section for being displaced when a speed of the movable section reaches a critical speed to activate the emergency stopping mechanism, and an emergency stopping operation mechanism for transmitting the displacement of the governor to said emergency stopping mechanism, the cage (movable section) of the elevator can be stopped with certainty.

According to the second aspect of the present invention, since a safety apparatus for an elevator comprises a guide rail of a conductor securely disposed along a path of upward and downward movement of the elevator, an emergency stopping mechanism mounted on a movable section of the elevator for gripping the guide rail to generate a frictional force to brake the movable section, a driving apparatus for operating the emergency stopping mechanism, a cam latch mechanism mounted on the movable section for releasing, when a speed of the movable section reaches a critical speed, a driving force of the driving apparatus which has been restricted till then, and a governor mounted on the movable section for being displaced when the speed of the movable section reaches the critical speed to activate the cam latch mechanism, even if the magnetic drag generated by eddy current is low and the pulling up force of the governor when an over-speed is detected is low, an emergency stopping operation can be performed with certainty (malfunctions are reduced) using the pulling up force as a trigger, and the emergency stopping mechanism can be returned to the initial state readily only by lifting the cage (movable section).

According to the third aspect of the present invention, since the safety apparatus for an elevator is constructed such that the governor includes a pickup including a magnet and a back yoke which form a magnetic circuit together with the guide rail, a pivotal arm having the pickup mounted at an end thereof and having a balance weight mounted at the other end thereof for transmitting a displacement of the pickup, a main shaft securely mounted at a fulcrum of the arm so as to be rotated in response to a displacement of the arm, and a base for supporting the main shaft thereon, the speed of the cage (movable section) can be detected directly, and the accuracy in detection of the speed is improved. Since an emergency stopping operation is started in response to the speed detected in this manner, the emergency stopping operation can be performed with certainty.

According to the fourth aspect of the present invention, since the safety apparatus for an elevator is constructed such that the governor includes a cam mounted on a main shaft of the governor which is rotated in accordance with a speed of the movable section, and a latch arm mounted on the governor by a latch pin for pivotal motion around an axis of the latch pin and having an end held in contact with the cam and the other end connected to the driving apparatus, and when the speed of the movable section reaches the critical speed, the cam is rotated to release the driving force of the driving apparatus, the driving force of the emergency stopping mechanism can be held, and even if the magnetic drag generated by eddy current is low and the pulling up force of the governor is low, an emergency stopping operation can be performed with certainty using the pulling up force of the governor as a trigger.

According to the fifth aspect of the present invention, since the safety apparatus for an elevator is constructed such that the driving apparatus includes a pulling up bar connected at an end thereof to the cam latch mechanism and at the other end thereof to the emergency stopping mechanism, and a spring element for lifting the pulling up bar when the speed of the movable section reaches the critical speed, a high driving force can act upon the emergency stopping mechanism, and an emergency stopping operation can be performed with certainty.

According to the sixth aspect of the present invention, since a safety apparatus for an elevator comprises a guide rail of a conductor securely disposed along a path of upward and downward movement of the elevator, an emergency stopping mechanism mounted on a movable section of the elevator for gripping the guide rail to generate a frictional force to brake the movable section, a pulling up wedge mechanism disposed for wedging engagement with the guide rail to generate a driving force for the emergency stopping mechanism, a cam latch mechanism mounted on the movable section for cooperating, when a speed of the movable section reaches a critical speed, with the pulling up wedge mechanism to activate the pulling up wedge mechanism, a governor mounted on the movable section for being displaced when the speed of the movable section reaches the critical speed to activate the cam latch mechanism, and a link apparatus for connecting the cam latch mechanism to the emergency stopping mechanism to transmit the driving force generated by the pulling up wedge mechanism to the emergency stopping mechanism, the force applied to the cam upon ordinary operation can be reduced, and also the force for an emergency stopping operation can be increased. Furthermore, also an emergency stop cancellation operation can be performed readily.

According to the seventh aspect of the present invention, since a safety apparatus for an elevator comprises a guide rail of a conductor securely disposed along a path of upward and downward movement of the elevator, an emergency stopping mechanism mounted on a movable section of the elevator for gripping the guide rail to generate a frictional force to brake the movable section, a governor for being displaced when a speed of the movable section reaches a critical speed, a pulling up wedge mechanism mounted on the governor for wedging engagement with the guide rail to generate a driving force for the emergency stopping mechanism, and a link apparatus for connecting the governor to the emergency stopping mechanism to transmit a driving force generated by the pulling up wedge mechanism to the emergency stopping mechanism, also the force for an emergency stopping operation is high, and also an emergency stop cancellation operation can be performed readily. Besides, since no cam latch mechanism is provided, also the construction is simplified.

According to the eighth aspect of the present invention, since the safety apparatus for an elevator is constructed such that it further comprises an auxiliary weight provided on any of the governor, emergency stopping operation mechanism and emergency stopping mechanism which is moved by the displacement of the governor, the overall operation mechanism section can be held in a well-balanced state, and also the accuracy in detection of the speed of the governor is improved advantageously.

According to the ninth aspect of the present invention, since the safety apparatus for an elevator is constructed such that the auxiliary weight is provided on an emergency stopping arm, the overall operation mechanism section can be held in a well-balanced state readily.

According to the tenth aspect of the present invention, since the safety apparatus for an elevator is constructed such that it further comprises a cancellation arm provided on any of the governor, emergency stopping operation mechanism and emergency stopping mechanism which is moved by the displacement of the governor, an emergency stop cancellation operation can be performed manually, and accordingly, a simple construction can be achieved without provision of an emergency stop cancellation mechanism.

According to the eleventh aspect of the present invention, since the safety apparatus for an elevator is constructed such that it further comprises a cancellation cam provided along the path of upward and downward movement of the elevator for engaging with the cancellation arm, an emergency stop cancellation operation can be performed automatically only by moving the elevator upwardly and downwardly.

According to the twelfth aspect of the present invention, since the safety apparatus for an elevator is constructed such that it further comprises an emergency stop cancellation mechanism including a holding down bar connected at an end thereof to the cam latch mechanism and at the other end thereof to the emergency stopping mechanism and a hook apparatus for being engaged with and restricting the driving apparatus when the holding down bar moves upwardly but releasing the engagement and restriction of the driving apparatus when the holding down bar moves downwardly, the emergency stopping mechanism can be returned to its initial state readily only by lifting the cage (movable section) upwardly.

According to the thirteenth aspect of the present invention, since the safety apparatus for an elevator is constructed such that the hook apparatus includes a hook mounted on the holding down bar, and an unhooking pin mounted on the governor for releasing a pulling up bar when the holding down bar moves downwardly, an emergency stop cancellation operation can be performed with a simple construction.

According to the fourteenth aspect of the present invention, since the safety apparatus for an elevator is constructed such that the emergency stopping mechanism includes an emergency stopping arm mounted for pivotal motion on the movable section, an emergency stopping shoe mounted at an end portion of the emergency stopping arm, and an emergency stopping biting metal member disposed for wedging engagement with the emergency stopping shoe and the guide rail, that the driving apparatus includes a pulling up bar having an end connected to the cam latch mechanism and the other end connected for sliding movement to a portion of the emergency stopping arm in the proximity of a pivot shaft of the emergency stopping arm via an elongated hole, and a spring element for lifting the pulling up bar when the speed of the movable section reaches the critical speed, that the emergency stop cancellation mechanism includes a holding down bar having an end connected for sliding movement to the cam latch mechanism via an elongated hole and the other end connected to an end portion of the emergency stopping arm, and a hook apparatus mounted on the holding down bar for being engaged with and restricting the pulling up bar when the holding down bar moves upwardly but releasing the engagement and restriction of the pulling up bar when the holding down bar moves downwardly, and that the holding down bar is moved, upon emergency stopping operation, upwardly over an extent larger by an amount corresponding to a length of the elongated hole than the pulling up bar due to a difference between displacements of locations of the emergency stopping arm different from the center of pivotal motion so that the hook apparatus is engaged with and restricts the pulling up bar, but upon emergency stopping cancellation operation, when the movable section is moved upwardly, while the emergency stopping biting metal member remains in wedging engagement with the guide rail, the emergency stopping arm is moved downwardly so that the holding down bar connected to the emergency stopping arm is moved downwardly and the pulling up bar which has been engaged with and restricted by the hook apparatus is moved downwardly by a displacement amount equal to that of the holding down bar until the engagement and restriction is cancelled at a position at which the driving apparatus restores an initial state, the emergency stopping mechanism can be returned to its initial position over a short distance over which the frictional force between the emergency stopping shoe and the guide rail is maintained.

According to the fifteenth aspect of the present invention, since the safety apparatus for an elevator is constructed such that it further comprises an oscillation absorption apparatus provided on any of the governor, emergency stopping operation mechanism and emergency stopping mechanism for absorbing oscillations, even if the cage is temporarily oscillated to a large extent and the speed of the cage is varied by passengers getting into or out of the elevator or moving violently in the cage (movable section), the oscillations can be absorbed, and a malfunction of the emergency stopping mechanism can be prevented.

According to the sixteenth aspect of the present invention, since the safety apparatus for an elevator is constructed such that it further comprises a guide rail of a conductor securely disposed along a path of upward and downward movement of the elevator, a governor for being displaced when a speed of a movable section reached a critical speed, and an emergency stopping mechanism provided on the governor for operating directly in response to a displacement of the governor to grasp the guide rail to generate a frictional force to brake the movable section, such members as a pulling up bar, a holding down bar and a pulling up wedge mechanism are unnecessary, and an emergency stopping operation can be performed directly by a displacement of the pickup and the safety apparatus for an elevator can be constructed with a reduced size and a simplified construction. Further, where the emergency stopping mechanism is disposed on the cage (cage frame), installation and adjustment can be performed readily and also inspection and maintenance are facilitated.

What is claimed is:

1. A safety apparatus for an elevator, comprising:

a conductive guide rail securely disposed along a path of upward and downward movement of said elevator;

an emergency stopping mechanism mounted on a movable section of said elevator for gripping said guide rail to generate a frictional force to brake said movable section;

a governor mounted on said movable section, said governor being displaceable in response to a magnetic force generated when a speed of said movable section reaches a critical speed, to thereby activate said emergency stopping mechanism; and an emergency stopping operation mechanism for transmitting the displacement of said governor to said emergency stopping mechanism.

2. A safety apparatus for an elevator according to claim 1, further comprising an auxiliary weight provided on one of said governor, emergency stopping operation mechanism and emergency stopping mechanism, which is moved by the displacement of said governor.

3. A safety apparatus for an elevator according to claim 2, wherein said auxiliary weight is provided on an emergency stopping arm.

4. A safety apparatus for an elevator according to claim 1, further comprising a cancellation arm provided on one of said governor, emergency stopping operation mechanism and emergency stopping mechanism which is moved by the displacement of said governor.

5. A safety apparatus for an elevator according to claim 4, further comprising a cancellation cam provided along said path of upward and downward movement of said elevator for engaging said cancellation arm.

6. A safety apparatus for an elevator according to claim 1, further comprising an oscillation absorption apparatus provided on one of said governor, emergency stopping operation mechanism and emergency stopping mechanism for absorbing oscillations.

7. A safety apparatus for an elevator, comprising:

a conductive guide rail securely disposed along with a path of upward and downward movement of said elevator;

an emergency stopping mechanism mounted on a movable section of said elevator for gripping said guide rail to generate a frictional force to brake said movable section;

a driving apparatus for operating said emergency stopping mechanism;

a cam latch mechanism mounted on said movable section for releasing, when a speed of said movable section reaches a critical speed, a driving force of said driving apparatus; and a governor mounted on said movable section, said governor being displaced when the speed of said movable section reaches a critical speed, to thereby activate said cam latch mechanism.

8. A safety apparatus for an elevator according to claim 7, wherein said governor includes a pickup including a magnet and a back yoke which form a magnetic circuit together with said guide rail, a pivotal arm having said pickup mounted at one end thereof and having a balance weight mounted at the other end thereof for transmitting a displacement of said pickup, a main shaft securely mounted at a fulcrum of said arm so as to be rotated in response to a displacement of said arm, and a base for supporting said main shaft thereon.

9. A safety apparatus for an elevator according to claim 7, wherein said governor includes a cam mounted on a main shaft of said governor which is rotated in accordance with a speed of said movable section, and a latch arm mounted on said governor by a latch pin for pivotal motion around an axis of said latch pin and having an end held in contact with said cam and the other end connected to said driving apparatus, and when the speed of said movable section reaches the critical speed, said cam is rotated to release the driving force of said driving apparatus.

10. A safety apparatus for an elevator according to claim 7, wherein said driving apparatus includes a pulling up bar connected at one end thereof to said cam latch mechanism and at the other end thereof to said emergency stopping mechanism, and a spring element for lifting said pulling up bar when the speed of said movable section reaches the critical speed.

11. A safety apparatus for an elevator according to claim 7, further comprising an emergency stop cancellation mechanism including a holding down bar connected at one end thereof to said cam latch mechanism and at the other end thereof to said emergency stopping mechanism, and a hook apparatus for engaging with and restricting said driving apparatus when said holding down bar moves upwardly but releasing the engagement and restriction of said driving apparatus when said holding down bar moves downwardly.

12. A safety apparatus for an elevator according to claim 11, wherein said hook apparatus includes a hook mounted on said holding down bar, and an unhooking pin mounted on said governor for releasing a pulling up bar when said holding down bar moves downwardly.

13. A safety apparatus for an elevator according to claim 11, wherein:

said emergency stopping mechanism includes an emergency stopping arm mounted for pivotal motion on said movable section, an emergency stopping shoe mounted at an end portion of said emergency stopping arm, and an emergency stopping biting metal member disposed for wedging engagement with said emergency stopping shoe and said guide rail;

said driving apparatus includes a pulling up bar having one end connected to said cam latch mechanism and the other end connected for sliding movement to a portion of said emergency stopping arm in the proximity of a pivot shaft of said emergency stopping arm via an elongated hole, and a spring element for lifting said pulling up bar when the speed of said movable section reaches the critical speed;

said emergency stop cancellation mechanism includes a holding down bar having one end connected for sliding movement to said cam latch mechanism via an elongated hole and the other end connected to an end potion of said emergency stopping arm, and a hook apparatus mounted on said holding down bar for engaging with and restricting said pulling up bar when said holding down bar moves upwardly but releasing the engagement and restriction of said pulling up bar when said holding down bar moves downwardly; and said holding down bar is moved, in an emergency stopping operation, upwardly over an extent larger, by an amount corresponding to a length of said elongated hole, than said pulling up bar due, to a difference between displacements of said emergency stopping arm with distance from a center of pivotal motion thereof so that said hook apparatus is engaged with and restricts said pulling up bar, and wherein in an emergency stopping cancellation operation, when said movable section is moved upwardly, while said emergency stopping biting metal member remains in wedging engagement with said guide rail, said emergency stopping arm is moved downwardly so that said holding down bar connected to said emergency stopping arm is moved downwardly and said pulling up bar which has been engaged with and restricted by said hook apparatus is moved downwardly by a displacement amount equal to that of said holding down bar until the engagement and restriction is cancelled at a position at which said driving apparatus is restored to an initial state.

14. A safety apparatus for an elevator, comprising:

a conductive guide rail securely disposed along a path of upward and downward movement of said elevator;

an emergency stopping mechanism mounted on a movable section of said elevator for gripping said guide rail to generate a frictional force to brake said movable section;

a pulling up wedge mechanism disposed for wedging engagement with said guide rail to generate a driving force for said emergency stopping mechanism;

a cam latch mechanism mounted on said movable section for cooperating, when a speed of said movable section reaches a critical speed, with said pulling up wedge mechanism to activate said pulling up wedge mechanism;

a governor mounted on said movable section, said governor being displaced when the speed of said movable section reaches a critical speed, to thereby activate said cam latch mechanism; and a link apparatus for connecting said cam latch mechanism to said emergency stopping mechanism to transmit the driving force generated by said pulling up wedge mechanism to said emergency stopping mechanism.

15. A safety apparatus for an elevator, comprising:

a conductive guide rail securely disposed along a path of upward and downward movement of said elevator;

an emergency stopping mechanism mounted on a movable section of said elevator for gripping said guide rail to generate a frictional force to brake said movable section;

a governor, said governor being displaceable in response to a magnetic force generated when a speed of said movable section reaches a critical speed;

a pulling up wedge mechanism mounted on said governor for wedging engagement with said guide rail to generate a driving force for said emergency stopping mechanism; and a link apparatus for connecting said governor to said emergency stopping mechanism to transmit a driving force generated by said pulling up wedge mechanism to said emergency stopping mechanism.

16. A safety apparatus for an elevator, comprising:

a conductive guide rail securely disposed along a path of upward and downward movement of said elevator;

a governor, said governor being displaceable in response to a magnetic force generated when a speed of a movable section reaches a critical speed; and an emergency stopping mechanism provided on said governor and operating directly in response to a displacement of said governor to grasp said guide rail to generate a frictional force to brake said movable section.

* * * * *